US011719121B2

(12) United States Patent
Uechi et al.

(10) Patent No.: US 11,719,121 B2
(45) Date of Patent: Aug. 8, 2023

(54) STEAM TURBINE

(71) Applicant: MITSUBISHI HEAVY INDUSTRIES, LTD., Tokyo (JP)

(72) Inventors: Hideyuki Uechi, Tokyo (JP); Hideaki Sugishita, Tokyo (JP); Takumi Matsumura, Tokyo (JP); Ryo Egami, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1025 days.

(21) Appl. No.: 16/341,998

(22) PCT Filed: Oct. 20, 2017

(86) PCT No.: PCT/JP2017/038025
§ 371 (c)(1),
(2) Date: Apr. 15, 2019

(87) PCT Pub. No.: WO2018/074593
PCT Pub. Date: Apr. 26, 2018

(65) Prior Publication Data

US 2021/0355841 A1 Nov. 18, 2021

(30) Foreign Application Priority Data

Oct. 21, 2016 (JP) ..... 2016-207164

(51) Int. Cl.
*F01D 21/12* (2006.01)
*F01D 21/00* (2006.01)
*F01D 25/26* (2006.01)

(52) U.S. Cl.
CPC ..... *F01D 21/12* (2013.01); *F01D 21/00* (2013.01); *F01D 25/26* (2013.01);
(Continued)

(58) Field of Classification Search
CPC ..... F01D 25/26; F01D 21/00; F01D 21/12; F01D 11/14
See application file for complete search history.

(56) References Cited

U.S. PATENT DOCUMENTS 2,650,794 A 9/1953 Röder
4,550,569 A * 11/1985 Isa ..... F01D 25/26 60/647

(Continued)

FOREIGN PATENT DOCUMENTS

JP 58-202311 11/1983
JP 59-007204 1/1984

(Continued)

OTHER PUBLICATIONS

International Search Report dated Nov. 28, 2017 in International (PCT) Application No. PCT/JP2017/038025 with English Translation.

(Continued)

*Primary Examiner* — Topaz L. Elliott
*Assistant Examiner* — Cameron A Corday
(74) *Attorney, Agent, or Firm* — Wenderoth, Lind & Ponack, L.L.P.

(57) ABSTRACT

A steam turbine includes an outer casing (19) that is provided with a first steam outlet port (54), through which exhaust steam flowing through the entire length of a flow path (21) defined between an inner casing main body (45) and an outer casing main body (51) in a direction along an axis ($O_1$) is discharged to the outside of the outer casing (19), and a second steam outlet port (55), which is provided in the outer casing main body (51) and through which the exhaust steam passing through a portion of the flow path (21) or the exhaust steam not passing through the flow path (21) is discharged to the outside of the outer casing (19); a first valve (28) that adjusts opening of the first steam outlet (Continued)

port (54); and a second valve (32) that adjusts opening of the second steam outlet port (55).

13 Claims, 22 Drawing Sheets

(52) U.S. Cl.
CPC ..... *F05D 2220/31* (2013.01); *F05D 2240/14* (2013.01); *F05D 2270/303* (2013.01)

(56) References Cited

U.S. PATENT DOCUMENTS

| | | | | |
|---|---|---|---|---|
| 8,662,823 | B2 | 3/2014 | Roy et al. | |
| 2012/0128474 | A1 | 5/2012 | Roy et al. | |
| 2016/0186597 | A1* | 6/2016 | Uesaka | F01D 21/00 415/48 |
| 2018/0238194 | A1* | 8/2018 | Tejima | F01D 25/12 |
| 2019/0010831 | A1* | 1/2019 | Kuhn | F01D 25/26 |

FOREIGN PATENT DOCUMENTS

| | | |
|---|---|---|
| JP | 59-229003 | 12/1984 |
| JP | 60-195304 | 10/1985 |
| JP | 2012-107618 | 6/2012 |

OTHER PUBLICATIONS

Written Opinion of the International Searching Authority dated Nov. 28, 2017 in International (PCT) Application No. PCT/JP2017/038025 with English Translation.

* cited by examiner

STEAM TURBINE

TECHNICAL FIELD

The present invention relates to a steam turbine.

Priority is claimed on Japanese Patent Application No. 2016-207164, filed on Oct. 21, 2016, the content of which is incorporated herein by reference.

BACKGROUND ART

A steam turbine is provided with a rotor that rotates around an axis and a casing that covers the rotor. The rotor is provided with a plurality of rotor blades that are disposed around a rotor shaft extending in an axial direction while being centered on the axis. The casing is provided with a plurality of stator vanes that are disposed around the rotor on an upstream side of the rotor blades.

For example, a steam turbine that includes an inner casing to which stator vanes are attached and an outer casing the covers the inner casing from the outside is described in PTL 1.

In the steam turbine, a flow path, through which operation steam flowing through an operation steam flow path between the inner casing and a rotor flows, is formed between the outer casing and the inner casing. Accordingly, the outer casing and the inner casing are cooled by the operation steam flowing through the flow path.

CITATION LIST

Patent Literature

[PTL 1] Japanese Unexamined Patent Application, First Publication No. 2012-107618

SUMMARY OF INVENTION

Technical Problem

Additionally, even in a case where the flow path through which steam flows is formed between the outer casing and the inner casing as described above, there is a possibility that a clearance between tip ends of the rotor blades and an inner circumferential surface of the inner casing and a clearance between tip ends of the stator vanes and the rotor are inadvertently narrowed although depending on the operation condition of the steam turbine.

The present invention provides a steam turbine with which it is possible to set a clearance between a rotor side and an inner casing side to an appropriate value.

Solution to Problem

In order to solve the above-described problem, a steam turbine according to an aspect of the invention includes: a rotor that is provided with a rotor main body rotating around an axis and a plurality of rotor blades arranged in an annular shape on an outer circumferential surface of the rotor main body; an inner casing that is provided with an inner casing main body, which accommodates the rotor, from which steam introduced thereto is discharged as exhaust steam from one end in a direction along the axis, and which is provided with an inner circumferential surface with a first clearance formed between the inner circumferential surface and tip ends of the plurality of rotor blades, and a steam inlet portion, which is provided on an outer side of the inner casing main body and through which the steam is introduced into the inner casing main body; a plurality of stator vanes that are arranged in an annular shape on an inner surface of the inner casing and of which tip ends face an outer circumferential surface of the rotor main body with a second clearance interposed therebetween; an outer casing that is provided with an outer casing main body, which accommodates the inner casing and which defines a flow path that extends in the direction along the axis between the outer casing main body and an outer circumferential surface of the inner casing main body and through which the exhaust steam flows, a first steam outlet port, which is provided in the outer casing main body and through which the exhaust steam flowing through an entire length of the flow path in the direction along the axis is discharged to an outside, and a second steam outlet port, which is provided in the outer casing main body and through which the exhaust steam passing through a portion of the flow path or the exhaust steam not passing through the flow path is discharged to the outside; a first valve that adjusts opening of the first steam outlet port; and a second valve that adjusts opening of the second steam outlet port.

According to the present invention, since the first steam outlet port through which exhaust steam flowing through the entire length of the flow path (flow path defined between outer circumferential surface of inner casing main body and outer casing main body) in the direction along the axis is discharged to the outside of the outer casing and the first valve that adjusts the opening of the first steam outlet port are provided, it is possible to reduce the size of the inner casing main body by cooling the inner casing main body by means of exhaust steam, which is steam lowered in temperature, at the time of the rated operation of the steam turbine.

Accordingly, it is possible to reduce the sizes of the first and second clearances at the time of the rated operation. Therefore, it is possible to suppress leakage of steam and to improve energy conversion efficiency.

Additionally, when the inner casing main body and the outer casing main body are cooled by using exhaust steam which is steam lowered in temperature at the time of transition from the rated operation state to operation stoppage of the steam turbine, there is a possibility of contact between the stator vanes and the rotor main body and contact between the rotor blades and the inner casing main body since the inner casing main body, of which the thickness is small and the thermal capacity is low, is lowered in temperature and is reduced in size earlier than the rotor of which the thermal capacity is high.

Additionally, when the inner casing main body and the outer casing main body are cooled by using exhaust steam in the period between when activation is performed at an operation stoppage state and when the rated operation is reached, there is a possibility of contact between the stator vanes and the rotor and contact between the rotor blades and the inner casing main body since the inner casing main body and the outer casing main body are reduced in size while the rotor is still in a state of being thermally expanded.

However, since the second steam outlet port through which exhaust steam passing through a portion of the flow path or exhaust steam not passing through the flow path is discharged to the outside of the outer casing and the second valve that adjusts the opening of the second steam outlet port are provided, the inner casing main body and the outer casing main body cooled by the exhaust steam in at least one of a period at which transition from the rated operation state to operation stoppage is performed and a period between when activation is performed at the operation stoppage state and when the rated operation is reached can be suppressed and since reduction in size of the inner casing main body and the outer casing main body can be suppressed, reduction in size of the clearances is suppressed in the above-described periods and thus the contact between the stator vanes and the rotor and the contact between the rotor blades and the inner casing main body can be suppressed.

Accordingly, reduction in size of the clearances is suppressed in at least one of a period at which transition from the rated operation state to operation stoppage is performed and a period between the operation stoppage state and the rated operation, the above-described periods being periods at which the first and second clearances are likely to become small due to a difference in amount of thermal expansion among the inner casing main body, the outer casing main body, and the rotor. Therefore, it is possible to set the clearances to be small at the time of initial assembly and thus to reduce the clearances at the time of a normal operation. In addition, it is possible to reduce the sizes of the clearances by cooling the inner casing main body and the outer casing main body by using exhaust steam which is steam lowered in temperature at the time of the normal operation.

That is, according to the present invention, it is possible to reduce the sizes of the first and second clearances at the time of the normal operation. Therefore, it is possible to suppress leakage of steam and to improve the efficiency of the steam turbine.

In addition, in the steam turbine according to the aspect of the invention, the outer casing main body may be provided with one end that faces one end of the inner casing main body and the other end that faces the other end of the inner casing main body, the first steam outlet port may be disposed closer to the other end of the outer casing main body than a position at which the steam inlet portion is provided, and the second steam outlet port may be disposed closer to the one end of the outer casing main body than a position at which the steam inlet portion is provided.

When the first steam outlet port is disposed closer to the other end of the outer casing main body than the position at which the steam inlet portion is provided as described above, exhaust steam flowing through the entire length of the flow path can be discharged to the outside of the outer casing via the first steam outlet port.

In addition, when the second steam outlet port is disposed closer to the one end of the outer casing main body than the position at which the steam inlet portion is provided, exhaust steam flowing through a portion of the flow path or exhaust steam not flowing through the flow path can be discharged to the outside of the outer casing via the second steam outlet port.

In addition, in the steam turbine according to the aspect of the invention, a flow path entrance adjustment member that narrows an entrance of the flow path may be provided between the outer circumferential surface of the inner casing main body that is positioned close to the one end of the inner casing main body and an inner circumferential surface of the outer casing main body.

When the flow path entrance adjustment member narrowing the entrance of the flow path is provided between the outer circumferential surface of the inner casing main body that is positioned close to the one end of the inner casing main body and the inner circumferential surface of the outer casing main body as described above, exhaust steam can be uniformly supplied with respect to a circumferential direction of the inner casing main body in the flow path. Therefore, it is possible to uniformly cool the inner casing main body and the outer casing main body defining the flow path.

In addition, in the steam turbine according to the aspect of the invention, the outer casing main body may be divided into an upper portion and a lower portion in a vertical direction, the second steam outlet port may be disposed in the upper portion or the lower portion that is positioned close to the one end of the inner casing main body, a flow path blocking member, which is disposed between one of the upper portion and the lower portion of the outer casing main body that is not provided with the second steam outlet port and the inner casing main body and which blocks a half side of the flow path on which the second steam outlet port is not provided, may be provided, and the first steam outlet port may be disposed in a portion of the outer casing main body that is positioned between the flow path blocking member and the other end of the inner casing main body.

When the first steam outlet port, the second steam outlet port, and the flow path blocking member configured as described are provided, exhaust steam that flows toward a lower portion of the flow path immediately after being discharged from the one end of the inner casing main body is blocked by the flow path blocking member and all of the exhaust steam flows to an upper portion of the flow path at the time of the rated operation of the steam turbine.

Accordingly, only exhaust steam that has passed through the upper portion of the flow path can be discharged to the outside of the outer casing through the first steam outlet port even if the first and second steam outlet ports and are not disposed only in the upper portion of the outer casing main body or only in the lower portion of the outer casing main body.

In addition, in the steam turbine according to the aspect of the invention, the outer casing main body may be divided into an upper portion and a lower portion in a vertical direction, the outer casing may be provided with a first flange portion provided outside the upper portion of the outer casing main body and a second flange portion provided outside the lower portion of the outer casing main body, the outer casing may be supported by a frame connected to the first flange portion, and a flow rate control member that decreases a flow rate of exhaust steam flowing through a lower portion of the flow path may be provided between the other end of a lower portion of the inner casing main body and the lower portion of the outer casing main body.

When the flow rate control member that decreases the flow rate of exhaust steam flowing through the flow path is provided between the other end of the lower portion of the inner casing main body and the lower portion of the outer casing main body in a case where the outer casing is supported by the frame connected to the first flange portion provided outside the upper portion of the outer casing main body, it is possible to make the amount of exhaust steam flowing to the upper portion of the flow path larger than the amount of exhaust steam flowing to the lower portion of the flow path.

Accordingly, it is possible to suppress thermal expansion of the upper portion of the outer casing main body and thus it is possible to suppress inclination of the first flange portion with respect to the upper end of the frame which is caused by thermal expansion of the upper portion of the outer casing main body.

In addition, in the steam turbine according to the aspect of the invention, the outer casing main body may be divided into an upper portion and a lower portion in a vertical direction, the outer casing may be provided with a first flange portion provided outside the upper portion of the outer casing main body and a second flange portion provided outside the lower portion of the outer casing main body, the outer casing may be supported by a frame connected to the second flange portion, and a flow rate control member that decreases a flow rate of exhaust steam flowing through an upper portion of the flow path may be provided between the other end of an upper portion of the inner casing main body and the upper portion of the outer casing main body.

When the flow rate control member that decreases the flow rate of exhaust steam flowing through the flow path is provided between the other end of the upper portion of the inner casing main body and the upper portion of the outer casing in a case where the outer casing is supported by the frame connected to the second flange portion provided outside the lower portion of the outer casing main body, it is possible to make the amount of exhaust steam flowing to the lower portion of the flow path larger than the amount of exhaust steam flowing to the upper portion of the flow path.

Accordingly, it is possible to suppress thermal expansion of the lower portion of the outer casing main body and thus it is possible to suppress inclination of the second flange portion with respect to the upper end of the frame which is caused by thermal expansion of the lower portion of the outer casing main body.

In addition, in the steam turbine according to the aspect of the invention, the first valve and the second valve may be on-off valves, the steam turbine may further include a control unit that is electrically connected to the first valve and the second valve, and the control unit may perform control such that the first valve is opened and the second valve is closed at the time of rated operation and performs control such that the first valve is closed and the second valve is opened in at least one of a period at which transition from a rated operation state to operation stoppage is performed and a period between when activation is performed at an operation stoppage time and when the rated operation is reached.

When the first valve, the second valve, and the control unit configured as described above are provided, an operation of discharging all of exhaust steam flowing through the entire length of the flow path to the outside of the outer casing via the first steam outlet port at the time of the rated operation and an operation of discharging all of exhaust steam flowing through a portion of the flow path or all of exhaust steam not flowing through the flow path to the outside of the outer casing via the second steam outlet port in at least one of a period at which transition from the rated operation state to operation stoppage is performed and a period between when activation is performed at the operation stoppage time and when the rated operation is reached can be automatically controlled.

In addition, in the steam turbine according to the aspect of the invention, the first valve and the second valve may be flow rate adjustment valves, the steam turbine may further include a control unit that is electrically connected to the first valve and the second valve, and the control unit may adjust openings of the first and second valves such that an amount of exhaust steam larger than a half of the exhaust steam present in the outer casing is discharged through the first steam outlet port at the time of rated operation and an amount of exhaust steam larger than a half of the exhaust steam is discharged through the second steam outlet port in at least one of a period at which transition from a rated operation state to operation stoppage is performed and a period between when activation is performed at an operation stoppage time and when the rated operation is reached.

When the first valve, the second valve, and the control unit configured as described above are provided, an operation of discharging an amount of exhaust steam larger than a half of exhaust steam flowing through the entire length of the flow path to the outside of the outer casing via the first steam outlet port at the time of the rated operation and an operation of discharging an amount of exhaust steam larger than a half of exhaust steam flowing through a portion of the flow path or exhaust steam not flowing through the flow path to the outside of the outer casing via the second steam outlet port in at least one of a period at which transition from the rated operation state to operation stoppage is performed and a period between when activation is performed at the operation stoppage time and when the rated operation is reached can be automatically controlled.

Furthermore, since the openings of the first and second valves can be adjusted, the flow rate of exhaust steam flowing through the flow path can be controlled.

In addition, in the steam turbine according to the aspect of the invention, the outer casing main body may be provided with a steam inlet port through which the steam is introduced into the steam inlet portion, the steam turbine may further include a control unit that is electrically connected to the first valve and the second valve, and a temperature measuring unit that measures at least one of a temperature of the steam inlet port, a temperature of the first steam outlet port, a temperature of the second steam outlet port, a temperature of the inner casing main body, a temperature of exhaust steam inside the outer casing main body, and a temperature of the outer casing main body, and the control unit may control opening and closing of the first and second valves when a slope of a curve of the temperature measured by the temperature measuring unit is greater than a predetermined slope at a predetermined time.

When the control unit and the temperature measuring unit as described above are provided, it is possible to control the first and second valves based on the control unit electrically connected to the first and second valves and at least one of the temperature of the steam inlet port, the temperature of the first steam outlet port, the temperature of the second steam outlet port, the temperature of the inner casing main body, the temperature of exhaust steam inside the outer casing main body, and the temperature of the outer casing main body. Therefore, it is possible to improve an effect of suppressing contact between the stator vanes and the rotor and contact between the rotor blades and the inner casing main body at the time of the rated operation, transition to stoppage, and activation.

In addition, since it is possible to estimate the temperature of exhaust steam by using the control unit electrically connected to the first and second valves and at least one of the temperature of the steam inlet port, the temperature of the first steam outlet port, the temperature of the second steam outlet port, the temperature of the inner casing main body, the temperature of exhaust steam inside the outer casing main body, and the temperature of the outer casing main body, it is possible to further improve an effect of suppressing contact between the stator vanes and the rotor and contact between the rotor blades and the inner casing main body at the time of the rated operation, the transition to stoppage, and the activation.

In addition, in the steam turbine according to the aspect of the invention, the inner casing main body may be provided with a first casing main body portion, into which first steam having a first pressure is introduced and from which the first steam is discharged as first exhaust steam through one end thereof, and a second casing main body portion, into which second steam having a second pressure higher than the first pressure is supplied and from which the second steam is discharged as second exhaust steam through one end thereof, the steam inlet portion may be provided with a first steam inlet portion through which the first steam is introduced into the first casing main body portion and a second steam inlet portion through which the second steam is introduced into the second casing main body portion, the outer casing main body may be provided with a third steam outlet port through which the second exhaust steam is discharged to the outside of the outer casing, the flow path through which the first exhaust steam flows may be defined between an outer circumferential surface of the first casing main body portion and an inner circumferential surface of the outer casing main body, the first exhaust steam flowing through the entire length of the flow path in the direction along the axis may be discharged to the outside of the outer casing through the first steam outlet port, and the first exhaust steam passing through a portion of the flow path or the first exhaust steam not passing through the flow path may be discharged to the outside of the outer casing through the second steam outlet port.

According to the above-described configuration, even in a case where the inner casing main body is provided with the first casing main body portion into which the first steam having the first pressure is introduced and from which the first steam is discharged as the first exhaust steam through the one end thereof and the second casing main body portion into which the second steam having the second pressure higher than the first pressure is supplied and from which the second steam is discharged as the second exhaust steam through the one end thereof, it is possible to suppress contact between the stator vanes and the rotor and contact between the rotor blades and the inner casing at the time of the rated operation, the transition to stoppage, and the activation while improving energy conversion efficiency at the time of the rated operation.

In addition, in the steam turbine according to the aspect of the invention, the first valve and the second valve may be on-off valves, the steam turbine may further include a control unit that is electrically connected to the first valve and the second valve, and the control unit may perform control such that the first valve is opened and the second valve is closed at the time of rated operation and performs control such that the first valve is closed and the second valve is opened in at least one of a period at which transition from a rated operation state to operation stoppage is performed and a period between when activation is performed at an operation stoppage time and when the rated operation is reached.

When the first valve, the second valve, and the control unit configured as described above are provided, all of exhaust steam flowing through the entire length of the flow path can be discharged to the outside of the outer casing via the first steam outlet port at the time of the rated operation and all of exhaust steam flowing through the entire length of the flow path can be discharged to the outside of the outer casing via the second steam outlet port in at least one of a period at which transition from the rated operation state to operation stoppage is performed and a period between when activation is performed at the operation stoppage time and when the rated operation is reached.

In addition, in the steam turbine according to the aspect of the invention, the first valve and the second valve may be flow rate adjustment valves, the steam turbine may further include a control unit that is electrically connected to the first valve and the second valve, and the control unit may adjust the opening of the first and second valves such that an amount of exhaust steam larger than a half of the exhaust steam present in the outer casing is discharged through the first steam outlet port at the time of rated operation and an amount of exhaust steam larger than a half of the exhaust steam is discharged through the second steam outlet port in at least one of a period at which transition from a rated operation state to operation stoppage is performed and a period between when activation is performed at an operation stoppage time and when the rated operation is reached.

When the first valve, the second valve, and the control unit configured as described above are provided, an amount of exhaust steam larger than half of exhaust steam flowing through the entire length of the flow path can be discharged to the outside of the outer casing via the first steam outlet port at the time of the rated operation and an amount of exhaust steam larger than half of exhaust steam flowing through the entire length of the flow path can be discharged to the outside of the outer casing via the second steam outlet port in at least one of a period at which transition from the rated operation state to operation stoppage is performed and a period between when activation is performed at the operation stoppage time and when the rated operation is reached.

In addition, the steam turbine according to the aspect of the invention may further include a clearance measuring unit that measures a value of at least one of the first clearance formed between the tip ends of the plurality of the rotor blades and the inner casing main body and the second clearance formed between the tip ends of the plurality of stator vanes and the outer casing main body, and the control unit may adjust the opening of the first and second valves based on a value of the clearance.

When the clearance measuring unit and the control unit configured as described above are provided, it is possible to further improve an effect of suppressing contact between the stator vanes and the rotor and contact between the rotor blades and the inner casing at the time of the rated operation, the transition to stoppage, and the activation.

Advantageous Effects of Invention

According to the present invention, it is possible to suppress contact between stator vanes and a rotor and contact between rotor blades and an inner casing main body at the time of rated operation, transition to stoppage, and activation while improving energy conversion efficiency at the time of the rated operation.

DESCRIPTION OF EMBODIMENTS

Figure 1:
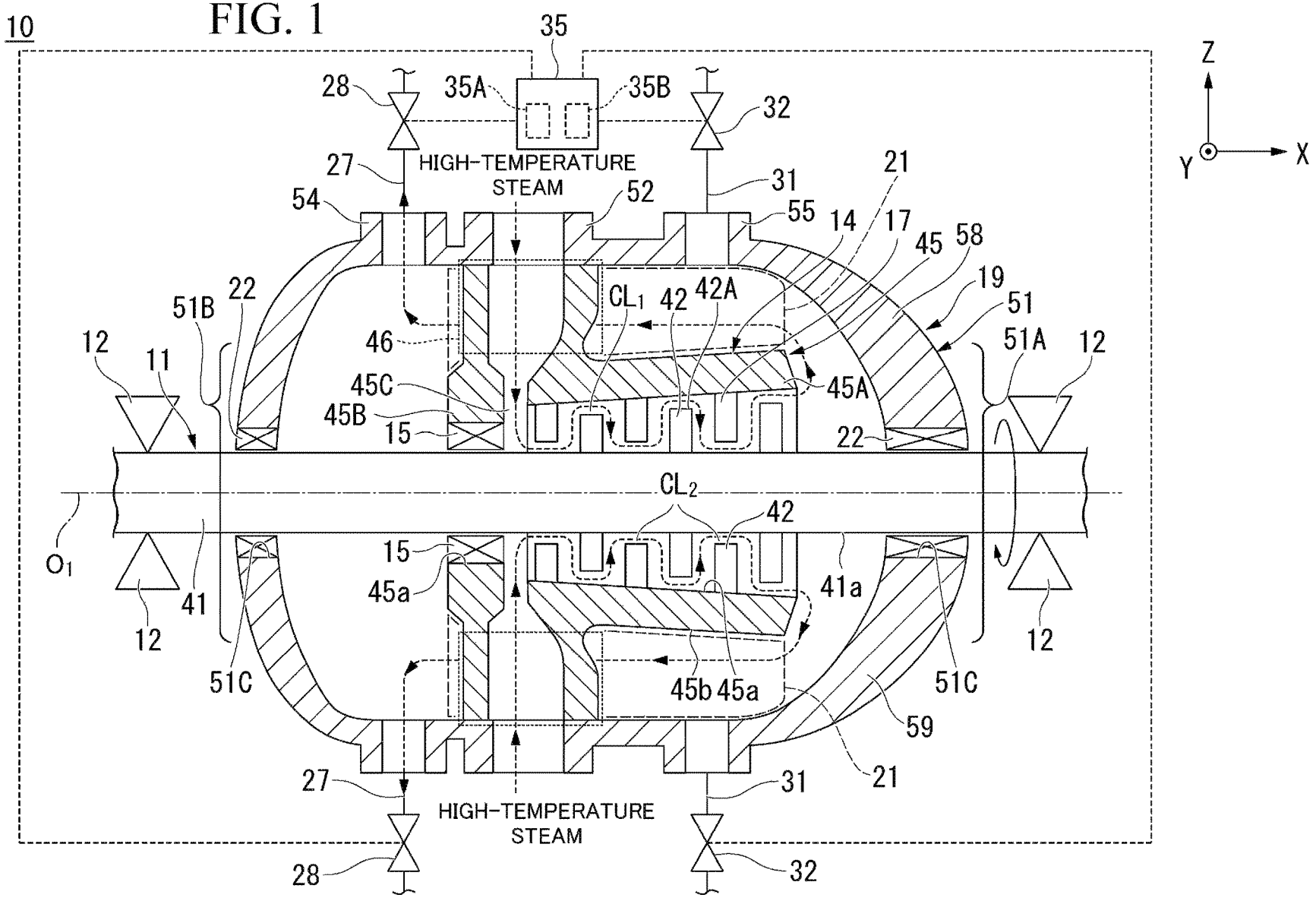
FIG. 1 is a sectional view schematically illustrating a schematic configuration of a steam turbine according to a first embodiment of the present invention and is a sectional view illustrating a direction in which exhaust steam flows at the time of a rated operation of the steam turbine.

Hereinafter, an embodiment of the present invention will be described in detail with reference to drawings. Note that, the drawings that are used in the following description are for describing the configuration of the embodiment of the present invention and the size, the thickness, the dimensions, or the like of each part illustrated in the drawings may be different from a relationship between the dimensions of an actual steam turbine.

First Embodiment

FIG. 1 is a sectional view schematically illustrating a schematic configuration of a steam turbine according to a first embodiment of the present invention and is a sectional view illustrating a direction in which exhaust steam flows at the time of rated operation of the steam turbine. In FIG. 1, an X direction is a direction in which a rotor main body 41 extends, a Y direction is a width direction of a steam turbine 10 that is orthogonal to the X direction, a Z direction is a vertical direction orthogonal to the X direction and the Y direction, and an axis O1 is a rotation axis of the rotor main body 41, respectively. Dotted arrows in FIG. 1 represent directions in which exhaust steam flows at the time of the rated operation of the steam turbine 10.

Figure 2:
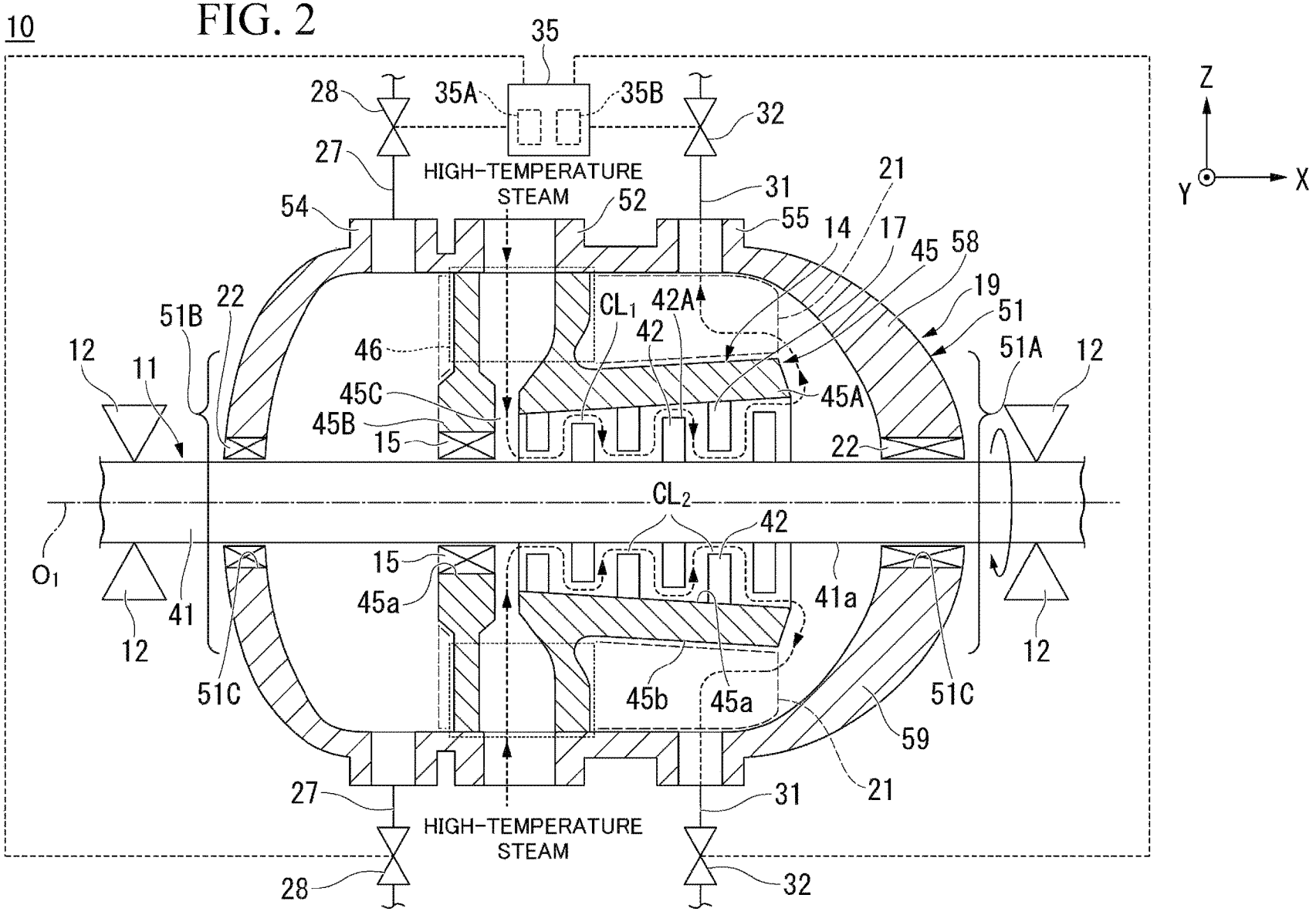
FIG. 2 is a sectional view schematically illustrating a schematic configuration of the steam turbine according to the first embodiment of the present invention and is a sectional view illustrating a direction in which exhaust steam flows at the time of transition to stoppage time and activation of the steam turbine.

FIG. 2 is a sectional view schematically illustrating a schematic configuration of the steam turbine according to the first embodiment of the present invention and is a sectional view illustrating a direction in which exhaust steam flows at the time of transition to stoppage time and activation of the steam turbine 10. Dotted arrows in FIG. 2 represent directions in which exhaust steam flows at the time of transition to stoppage and activation of the steam turbine 10. In FIG. 2, the same components as those in a structure shown in FIG. 1 are given the same symbols.

Note that, the time of transition to stoppage in the present invention refers to a period at which transition from the rated operation to operation stoppage is performed and the time of activation refers to a period between when a rotor 11 is activated in an operation stoppage state where the rotor 11 is not sufficiently cooled and when the rated operation is reached.

Figure 3:
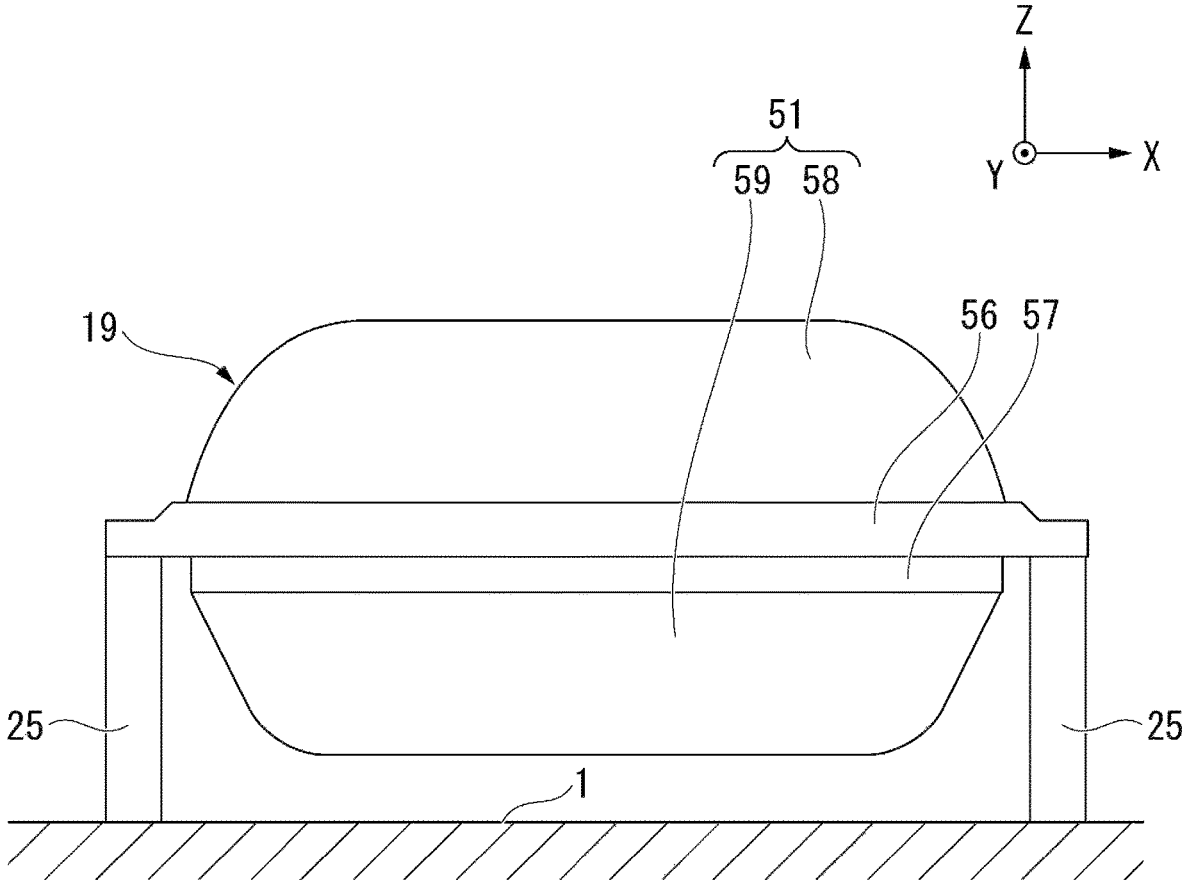
FIG. 3 is a view illustrating an outer appearance of the steam turbine in FIG. 1 as seen from a side.

FIG. 3 is a view illustrating an outer appearance of the steam turbine in FIG. 1 as seen from a side. In FIG. 3, the same components as those in a structure shown in FIG. 1 and FIG. 2 are given the same symbols.

As shown in FIGS. 1 to 3, the steam turbine 10 in the first embodiment includes the rotor 11, a pair of bearings 12, an inner casing 14, seal members 15 and 22, a plurality of stator vanes 17, an outer casing 19, a frame 25, first outlet lines 27, first valves 28, second outlet lines 31, second valves 32, and a control unit 35.

The rotor 11 is provided with the rotor main body 41 and a plurality of rotor blades 42. The rotor main body 41 is a metal member having a cylindrical shape and is disposed to extend in the X direction. The rotor main body 41 is configured to be able to rotate around the axis O1.

The plurality of rotor blades 42 are arranged in an annular shape on an outer circumferential surface 41*a* of the rotor main body 41. The plurality of rotor blades 42 are erected to face an inner circumferential surface 45*a* of an inner casing main body 45, which will be described later. Tip ends 42A of the plurality of rotor blades 42 face the inner circumferential surface 45*a* of the inner casing main body 45. A first clearance $CL_1$ is provided between the tip ends 42A of the plurality of rotor blades 42 and the inner circumferential surface 45*a* of the inner casing main body 45. The size of the first clearance $CL_1$ is set to be a predetermined value.

The pair of bearings 12 supports the rotor main body 41 in a state of being rotatable.

The inner casing 14 is a metal casing and is provided with the inner casing main body 45 and steam inlet portions 46.

The inner casing main body 45 has a cylindrical shape of which the inside can communicate with the rotor main body 41. The inner casing main body 45 accommodates the rotor main body 41.

The inner casing main body 45 is provided with the inner circumferential surface 45*a* facing the outer circumferential surface 41*a* of the rotor main body 41, an outer circumferential surface 45*b* facing the outer casing 19, one end 45A from which steam is discharged as exhaust steam, and the other end 45B.

On a side close to the other end 45B of the inner casing main body 45, steam inlet holes 45C for introducing high-temperature steam into the inner casing main body 45 are provided.

Regarding the inner casing main body 45, steam which has passed through the inner casing main body 45 and of which the temperature has been lowered is discharged into the outer casing 19 as exhaust steam from the one end 45A.

A plurality of the steam inlet portions 46 are provided on the outside of the inner casing main body 45. Each steam inlet portion 46 extends in a direction intersecting the inner casing main body 45 and is connected to the inside of the outer casing 19. Accordingly, the inner casing main body 45 is supported by the outer casing 19 via the steam inlet portions 46.

Through the steam inlet portions 46, high-temperature steam is introduced into the inner casing main body 45 via the steam inlet holes 45C.

The thickness of the inner casing 14 configured as described above is smaller than the thickness of the rotor 11 described above.

The seal member 15 is provided on the inner circumferential surface 45*a* of the other end 45B of the inner casing main body 45. The seal member 15 surrounds a circumferential direction of the rotor main body 41 in a state where a gap is interposed therebetween.

The plurality of stator vanes 17 are arranged in an annular shape on the inner circumferential surface 45*a* of the inner casing main body 45. The plurality of stator vanes 17 are erected to face the outer circumferential surface 41*a* of the rotor main body 41.

Tip ends 17A of the plurality of stator vanes 17 face the outer circumferential surface 41*a* of the rotor main body 41. A second clearance $CL_2$ is provided between the tip ends 17A of the plurality of stator vanes 17 and the outer circumferential surface 41*a* of the rotor main body 41. The size of the second clearance $CL_2$ is set to be a predetermined value.

The outer casing 19 is a metal casing and is provided with an outer casing main body 51, steam inlet ports 52, first steam outlet ports 54, second steam outlet ports 55, a first flange portion 56, and a second flange portion 57.

The outer casing main body 51 accommodates the inner casing 14. The outer casing main body 51 is provided with one end 51A facing the one end 45A of the inner casing main body 45 and the other end 51B facing the other end 45B of the inner casing main body 45.

The outer casing main body 51 is divided into an upper portion 58 and a lower portion 59 in the Z direction.

In addition, the outer casing main body 51 is provided with a pair of rotor insertion holes 51C disposed to face each other in the X direction. The rotor main body 41 is inserted into the pair of rotor insertion holes 51C.

A tubular flow path 21, through which the exhaust steam (high-temperature steam of which temperature has been lowered) discharged from the one end 45A of the inner casing main body 45 can flow in a direction along the axis $O_1$, is defined between a portion of the outer casing main body 51 that faces the outer circumferential surface 45*b* of the inner casing main body 45 and the outer circumferential surface 45*b* of the inner casing main body 45. That is, the outer casing main body 51 accommodates the inner casing 14 in a state where the flow path 21 can be defined.

The outer casing main body 51 which faces the steam inlet portions 46 is provided with the steam inlet ports 52. Through the steam inlet ports 52, high-temperature steam is introduced into the inner casing main body 45 via the steam inlet portions 46.

The outer casing main body 51 is provided with a plurality of the first steam outlet ports 54. The first steam outlet ports 54 are disposed closer to the other end 51B of the outer casing main body 51 than positions at which the steam inlet ports 52 are provided.

Exhaust steam flowing through the entire length of the flow path 21 in the direction along the axis $O_1$ is discharged to the outside of the outer casing 19 through the first steam outlet ports 54 (refer to dotted arrows in FIG. 1).

The outer casing main body 51 is provided with a plurality of the second steam outlet ports 55. The second steam outlet ports 55 are disposed closer to the one end 51A of the outer casing main body 51 than positions at which the steam inlet ports 52 are provided.

Exhaust steam flowing through a portion of the flow path 21 is discharged to the outside of the outer casing 19 through the second steam outlet ports 55 (refer to dotted arrows in FIG. 2).

An outer peripheral portion of a lower end of the upper portion 58 of the outer casing main body 51 is provided with the first flange portion 56. The first flange portion 56 is connected to an upper end of the frame 25 disposed to be separated therefrom in the X direction. The first flange portion 56 and the frame 25 are connected to each other by means of a bolt or the like (not shown), for example. Accordingly, the outer casing 19 is supported on a floor 1 by the frame 25.

An outer peripheral portion of an upper end of the lower portion 59 of the outer casing main body 51 is provided with the second flange portion 57. The second flange portion 57 is connected to the first flange portion 56 by means of a bolt or the like (not shown), for example.

The thickness of the outer casing 19 configured as described above is smaller than the thickness of the rotor 11 described above.

The seal member 22 is provided for each of the pair of rotor insertion holes 51C. Each seal member 22 surrounds the circumferential direction of the rotor main body 41 in a state where a gap is interposed therebetween.

The frame 25 is disposed in the X direction. A lower end of the frame 25 is fixed to the floor 1 and the upper end of the frame 25 is connected to the first flange portion 56.

The first outlet lines 27 are connected to the first steam outlet ports 54. The first outlet lines 27 are lines for discharging exhaust steam to the outside of the outer casing 19.

The first valves 28 are connected to the first outlet lines 27. At the time of the rated operation, exhaust steam is discharged to the first outlet lines 27 when the first valves 28 are open and discharge of exhaust steam to the first outlet lines 27 is stopped when the first valves 28 are closed. The first valves 28 are valves for adjusting the opening of the first steam outlet ports 54.

As the first valves 28, for example, on-off valves or flow rate adjustment valves can be used.

The second outlet lines 31 are connected to the second steam outlet ports 55. The second outlet lines 31 are lines for discharging exhaust steam to the outside of the outer casing 19.

The second valves 32 are connected to the second outlet lines 31. At the time of transition to stoppage and at the time of activation, exhaust steam is discharged to the second outlet lines 31 when the second valves 32 are open and discharge of exhaust steam to the second outlet lines 31 is stopped when the second valves 32 are closed. The second valves 32 are valves for adjusting the opening of the second steam outlet ports 55.

As the second valves 32, for example, on-off valves or flow rate adjustment valves can be used.

The control unit 35 controls the entire steam turbine 10. The control unit 35 includes a storage unit 35A and a calculation unit 35B.

A program related to control of the steam turbine 10, a program related to the timing of opening and closing of the first and second valves 28 and 32, or the like is stored in the storage unit 35A. In addition, in a case where the first and second valves 28 and 32 are flow rate adjustment valves, information related to the opening of the first and second valves 28 and 32 is stored in the storage unit 35A.

The control unit 35 is electrically connected to the first and second valves 28 and 32.

In a case where the first and second valves 28 and 32 are on-off valves, the control unit 35 performs control such that the first valves 28 are opened and the second valves 32 are closed at the time of the rated operation and performs control such that the first valves 28 are closed and the second valves 32 are opened in at least one of a period at which transition from a rated operation state to operation stoppage is performed (time of transition to stoppage) and a period between when activation is performed at an operation stoppage time and when the rated operation is reached (time of activation).

In a case where the first and second valves 28 and 32 are on-off valves, an operation of discharging all of exhaust steam flowing through the entire length of the flow path 21 to the outside of the outer casing 19 via the first steam outlet ports 54 at the time of rated operation and an operation of discharging all of exhaust steam flowing through a portion of the flow path 21 or all of exhaust steam not flowing through the flow path 21 to the outside of the outer casing 19 via the second steam outlet ports 55 at the time of transition to stoppage and the time of activation can be automatically controlled since the control unit 35 configured as described above is provided.

In addition, in a case where the first and second valves 28 and 32 are flow rate adjustment valves, an operation of discharging an amount of exhaust steam larger than a half of exhaust steam flowing through the entire length of the flow path 21 to the outside of the outer casing 19 via the first steam outlet ports 54 at the time of rated operation and an operation of discharging an amount of exhaust steam larger than a half of exhaust steam flowing through a portion of the flow path 21 or exhaust steam not flowing through the flow path to the outside of the outer casing 19 via the second steam outlet ports 55 at the time of transition to stoppage and the time of activation can be automatically controlled since the control unit 35 configured as described above is provided.

Furthermore, since the opening of the first and second valves 28 and 32 can be adjusted, exhaust steam flowing through the flow path 21 can be controlled.

According to the steam turbine 10 in the first embodiment, since the first steam outlet ports 54 through which exhaust steam flowing through the entire length of the flow path 21 in the direction along the axis $O_1$ is discharged to the outside of the outer casing 19 and the first valves 28 that adjust the opening of the first steam outlet ports 54 are provided, it is possible to reduce the size of the inner casing main body 45 by cooling the inner casing main body 45 by means of exhaust steam, which is steam lowered in temperature, at the time of the rated operation of the steam turbine 10.

Accordingly, it is possible to reduce the sizes of the first and second clearances $CL_1$ and $CL_2$ at the time of the rated operation. Therefore, it is possible to suppress leakage of steam and to improve energy conversion efficiency.

Additionally, when the inner casing main body 45 and the outer casing main body 51 are cooled by using exhaust steam which is steam lowered in temperature at the time of transition to stoppage of the steam turbine 10, there is a possibility of contact between the stator vanes 17 and the rotor main body 41 and contact between the rotor blades 42 and the inner casing main body 45 since the inner casing main body 45, of which the thickness is small and the thermal capacity is low, is lowered in temperature and is reduced in size earlier than the rotor 11 of which the thermal capacity is high.

Additionally, when the inner casing main body 45 and the outer casing main body 51 are cooled by using exhaust steam in a period between when activation is performed at an operation stoppage state and when the rated operation is reached, there is a possibility of contact between the stator vanes 17 and the rotor 11 and contact between the rotor blades 42 and the inner casing main body 45 since the inner casing main body 45 and the outer casing main body 51 are reduced in size while the rotor 11 is still in a state of being thermally expanded.

However, since the second steam outlet ports 55 through which exhaust steam passing through a portion of the flow path 21 is discharged to the outside of the outer casing 19 and the second valves 32 that adjust the opening of the second steam outlet ports 55 are provided, the inner casing main body 45 and the outer casing main body cooled by the exhaust steam in at least one of a period at which transition from the rated operation state to operation stoppage is performed and a period between when activation is performed at the operation stoppage state and when the rated operation is reached can be suppressed and since reduction in size of the inner casing main body 45 and the outer casing main body 51 can be suppressed, reduction in size of the first and second clearances $CL_1$ and $CL_2$ is suppressed in the above-described periods and thus the contact between the stator vanes 17 and the rotor 11 and the contact between the rotor blades 42 and the inner casing main body 45 can be suppressed.

That is, according to the steam turbine 10 in the first embodiment, it is possible to suppress leakage of steam by reducing the sizes of the first and second clearances $CL_1$ and $CL_2$ at the time of a normal operation and thus to improve the efficiency of the steam turbine 10.

Note that, in the first embodiment, a case where opening and closing of the first and second valves 28 and 32 are controlled by using the control unit 35 has been described as an example. However, the first and second valves 28 and 32 may be opened and closed manually.

Second Embodiment

Figure 4:
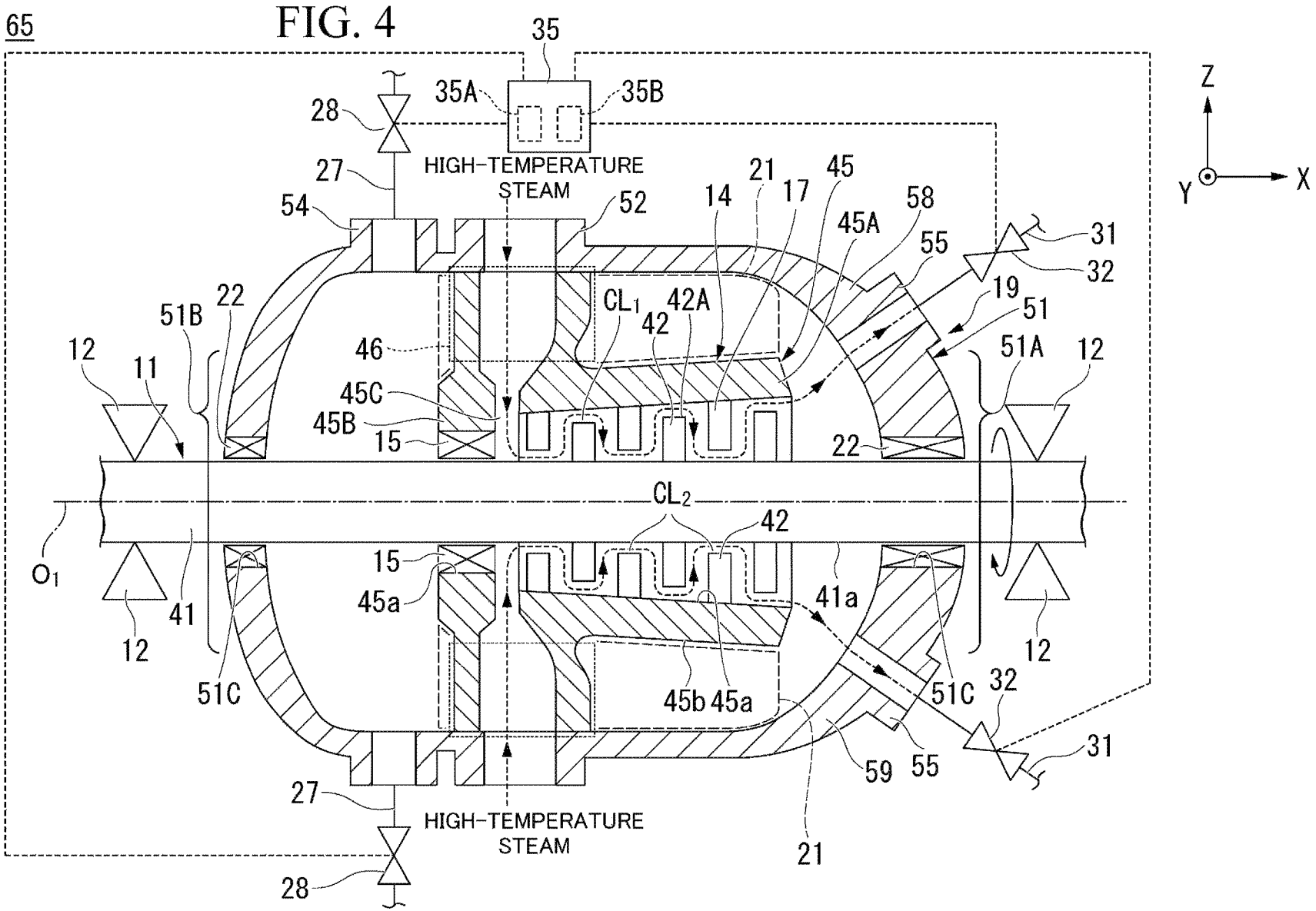
FIG. 4 is a sectional view schematically illustrating a schematic configuration of a steam turbine according to a second embodiment of the present invention and is a sectional view illustrating a direction in which exhaust steam flows at the time of transition to stoppage and activation of the steam turbine.

FIG. 4 is a sectional view schematically illustrating a schematic configuration of a steam turbine according to a second embodiment of the present invention and is a sectional view illustrating a direction in which exhaust steam flows at the time of transition to stoppage and activation of the steam turbine. Dotted arrows in FIG. 4 represent directions in which exhaust steam flows at the time of transition to stoppage and activation of the steam turbine. In FIG. 4, the same components as those in a structure shown in FIG. 1 and FIG. 2 are given the same symbols.

As understood from FIG. 4, a steam turbine 65 in the second embodiment has the same configuration as the steam turbine 10 except that the second steam outlet ports 55 constituting the steam turbine 10 in the first embodiment are disposed closer to the one end 51A of the outer casing main body 51 than the one end 45A of the inner casing main body 45.

According to the steam turbine 65 in the second embodiment, since exhaust steam does not pass through the flow path 21 at the time of transition to stoppage and the time of activation, the inner casing main body 45 cooled by the exhaust steam can be suppressed.

Note that, in the steam turbine 65 in the second embodiment as well, it is possible to control the first and second valves 28 and 32 in the same manner as in the first embodiment described above.

Third Embodiment

Figure 5:
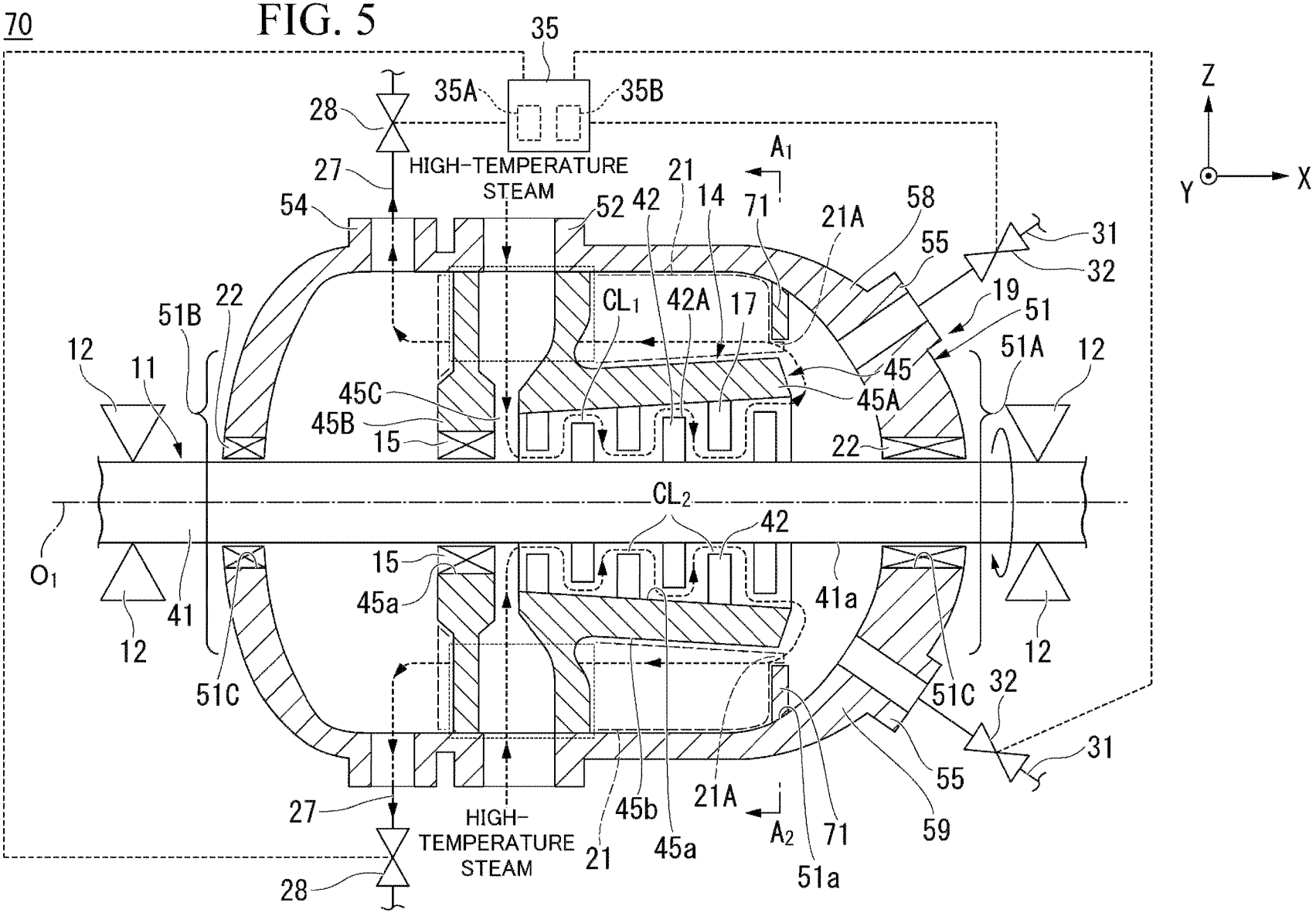
FIG. 5 is a sectional view schematically illustrating a schematic configuration of a steam turbine according to a third embodiment of the present invention and is a sectional view illustrating a direction in which exhaust steam flows at the time of the rated operation of the steam turbine.

FIG. 5 is a sectional view schematically illustrating a schematic configuration of a steam turbine according to a third embodiment of the present invention and is a sectional view illustrating a direction in which exhaust steam flows at the time of the rated operation of the steam turbine. Dotted arrows in FIG. 5 represent directions in which exhaust steam flows at the time of the rated operation of a steam turbine 70. In FIG. 5, the same components as those in a structure shown in FIG. 4 are given the same symbols.

Figure 6:
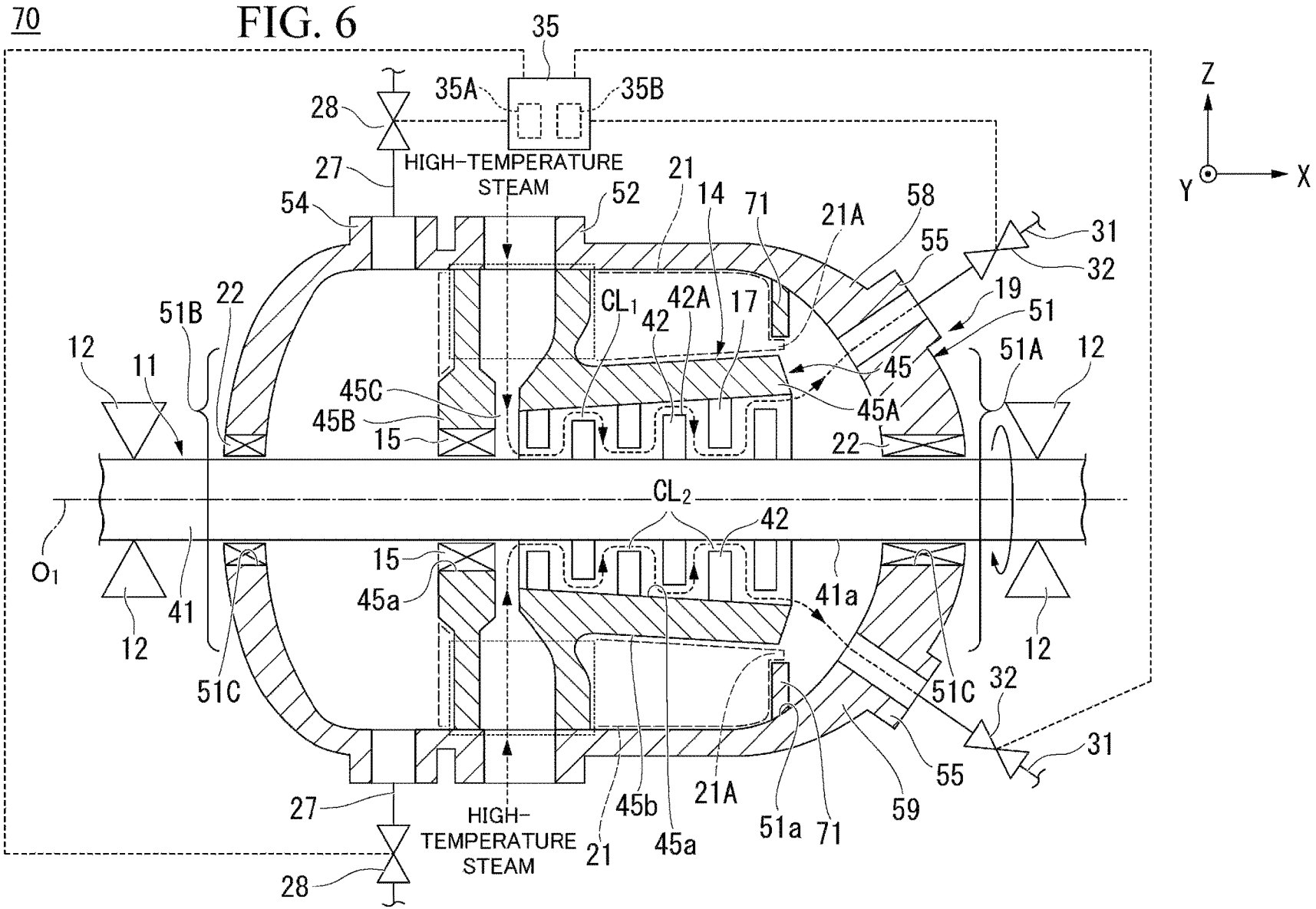
FIG. 6 is a sectional view schematically illustrating a schematic configuration of the steam turbine according to the third embodiment of the present invention and is a sectional view illustrating a direction in which exhaust steam flows at the time of transition to stoppage and activation of the steam turbine.

FIG. 6 is a sectional view schematically illustrating a schematic configuration of the steam turbine according to the third embodiment of the present invention and is a sectional view illustrating a direction in which exhaust steam flows at the time of transition to stoppage and activation of the steam turbine. Dotted arrows in FIG. 6 represent directions in which exhaust steam flows at the time of transition to stoppage and activation of the steam turbine 70.

Figure 7:
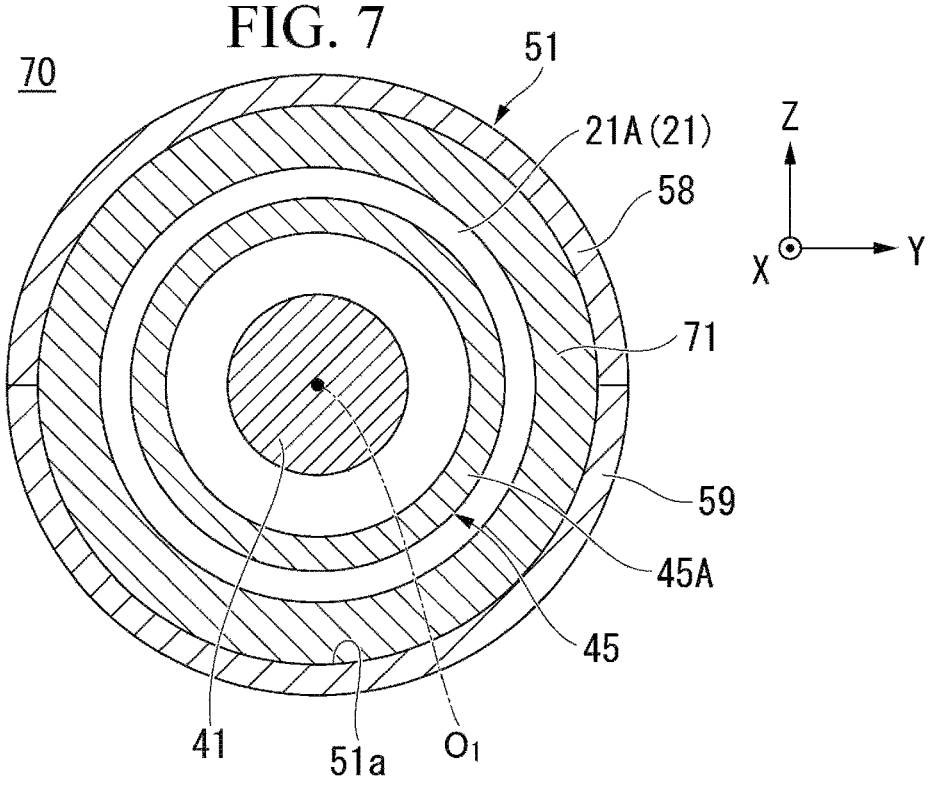
FIG. 7 is a sectional view of the steam turbine shown in FIG. 5 taken along line $A_1$-$A_2$.

FIG. 7 is a sectional view of the steam turbine shown in FIG. 5 taken along line $A_1$-$A_2$. In FIG. 7, the first flange portion 56 and the second flange portion 57 shown in FIG. 3 are not shown. In FIG. 7, the same components as those in a structure shown in FIG. 5 are given the same symbols.

As understood from FIGS. 5 to 7, the steam turbine 70 in the third embodiment has the same configuration as the steam turbine 65 except that a configuration of the steam turbine 65 in the second embodiment further includes a flow path entrance adjustment member 71.

The flow path entrance adjustment member 71 is a ring-shaped member and is provided on an inner circumferential surface 51*a* of the outer casing main body 51 such that a ring-shaped space (entrance 21A of flow path 21) is defined between the flow path entrance adjustment member 71 and the one end 45A of the inner casing main body 45. The flow path entrance adjustment member 71 has a function of narrowing the entrance 21A of the flow path 21.

According to the steam turbine 70 in the third embodiment, since the flow path entrance adjustment member 71 narrowing the entrance 21A of the flow path 21 is provided between the outer circumferential surface 45*b* of the inner casing main body 45 that is positioned close to the one end 45A of the inner casing main body 45 and the inner circumferential surface 51*a* of the outer casing main body 51, exhaust steam can be uniformly supplied into the flow path 21 with respect to a circumferential direction of the inner casing main body 45. Therefore, it is possible to uniformly cool the inner casing main body 45 and the outer casing main body 51 defining the flow path 21.

Note that, it is sufficient that the flow path entrance adjustment member 71 is provided between the outer circumferential surface 45*b* of the inner casing main body 45 that is positioned close to the one end 45A of the inner casing main body 45 and the inner circumferential surface 51*a* of the outer casing main body 51.

In addition, in the steam turbine 70 in the third embodiment as well, it is possible to control the first and second valves 28 and 32 in the same manner as in the first embodiment described above.

Figure 8:
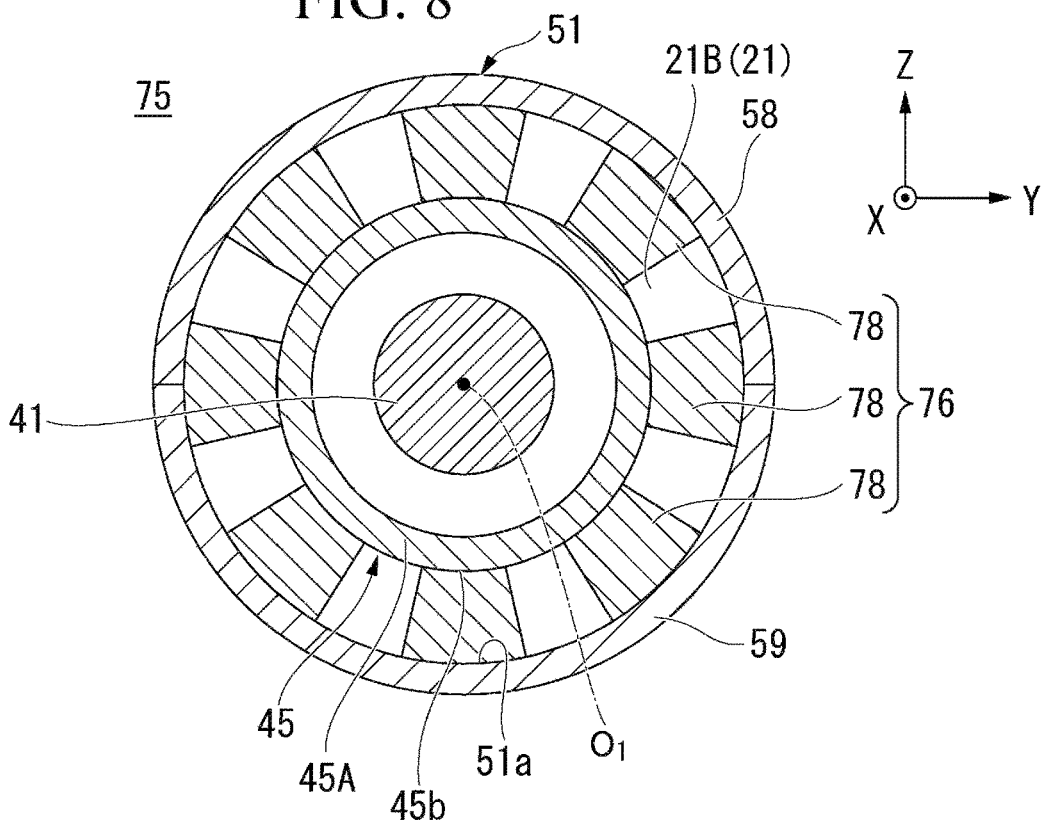
FIG. 8 is a sectional view of a main part of a steam turbine according to a first modification example of the third embodiment of the present invention.

FIG. 8 is a sectional view of a main part of a steam turbine according to a first modification example of the third embodiment of the present invention. In FIG. 7, the first flange portion 56 and the second flange portion 57 shown in FIG. 3 are not shown. In FIG. 8, the same components as those in a structure shown in FIG. 7 are given the same symbols.

As understood from FIG. 8, a steam turbine 75 according to the first modification example of the third embodiment has the same configuration as the steam turbine 70 except that a flow path entrance adjustment member 76 is provided instead of the flow path entrance adjustment member 71 constituting the steam turbine 70 in the third embodiment.

The flow path entrance adjustment member 76 is composed of a plurality of plate portions 78. The plurality of plate portions 78 are provided to connect the outer circumferential surface 45*b* of the inner casing main body 45 and the inner circumferential surface 51*a* of the outer casing main body 51 to each other. The plurality of plate portions 78 are disposed at predetermined intervals in the circumferential direction of the inner casing main body 45. An entrance 21B of the flow path 21 is defined between two adjacent plate portions 78.

According to the steam turbine 75 in the first modification example of the third embodiment which is configured as described above, it is possible to achieve the same effect as the steam turbine 70 in the third embodiment.

Note that, it is sufficient that the flow path entrance adjustment member 76 is provided between the outer circumferential surface 45*b* of the inner casing main body 45 that is positioned close to the one end 45A of the inner casing main body 45 and the inner circumferential surface 51*a* of the outer casing main body 51.

Figure 9:
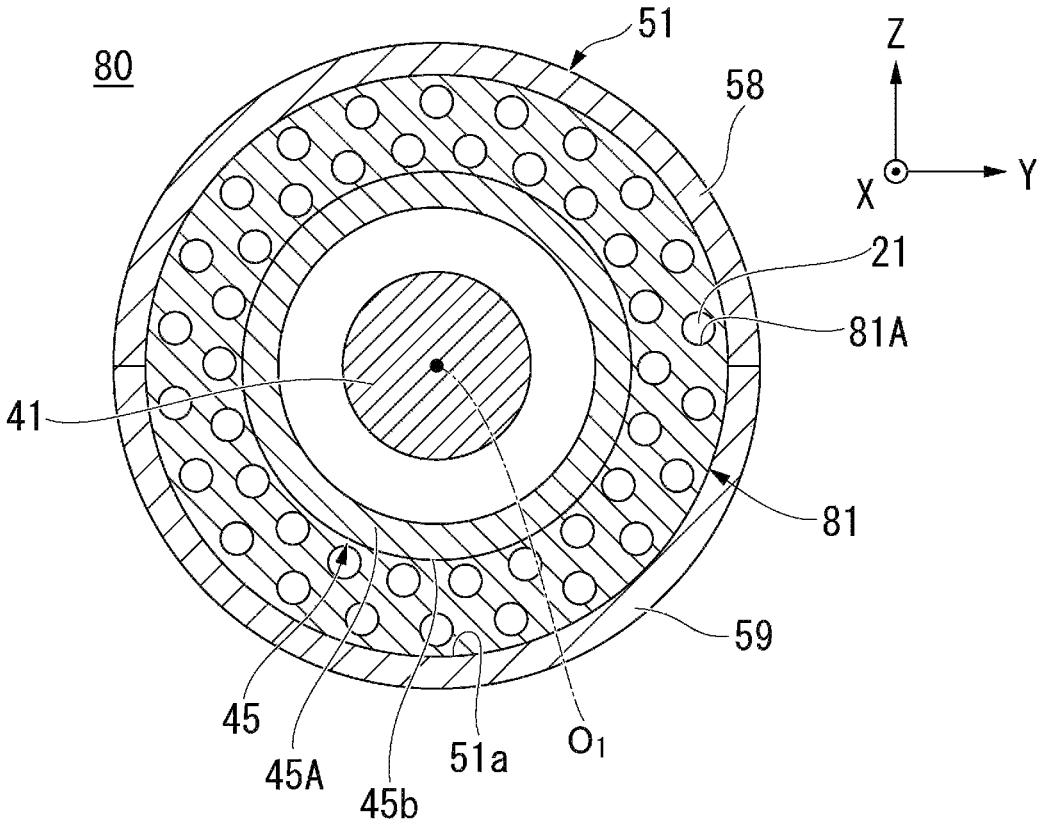
FIG. 9 is a sectional view of a main part of a steam turbine according to a second modification example of the third embodiment of the present invention.

FIG. 9 is a sectional view of a main part of a steam turbine according to a second modification example of the third embodiment of the present invention. In FIG. 9, the first flange portion 56 and the second flange portion 57 shown in FIG. 3 are not shown. In FIG. 9, the same components as those in a structure shown in FIG. 7 are given the same symbols.

As understood from FIG. 9, a steam turbine 80 according to the second modification example of the third embodiment has the same configuration as the steam turbine 70 except that a flow path entrance adjustment member 81 is provided instead of the flow path entrance adjustment member 71 constituting the steam turbine 70 in the third embodiment.

The flow path entrance adjustment member 81 is provided to connect the outer circumferential surface 45*b* of the inner casing main body 45 and the inner circumferential surface 51*a* of the outer casing main body 51 to each other. The flow path entrance adjustment member 81 is configured such that a plurality of through-holes 81A are formed in a plate member at a uniform density. The shape of the through-hole 81A can be set to, for example, a circular shape although the shape is not limited thereto. The shape of the through-hole 81A may be, for example, a polygonal shape.

According to the steam turbine 80 in the second modification example of the third embodiment which is configured as described above, it is possible to achieve the same effect as the steam turbine 70 in the third embodiment.

Note that, it is sufficient that the flow path entrance adjustment member 81 is provided between the outer circumferential surface 45*b* of the inner casing main body 45 that is positioned close to the one end 45A of the inner casing main body 45 and the inner circumferential surface 51*a* of the outer casing main body 51.

Fourth Embodiment

Figure 10:
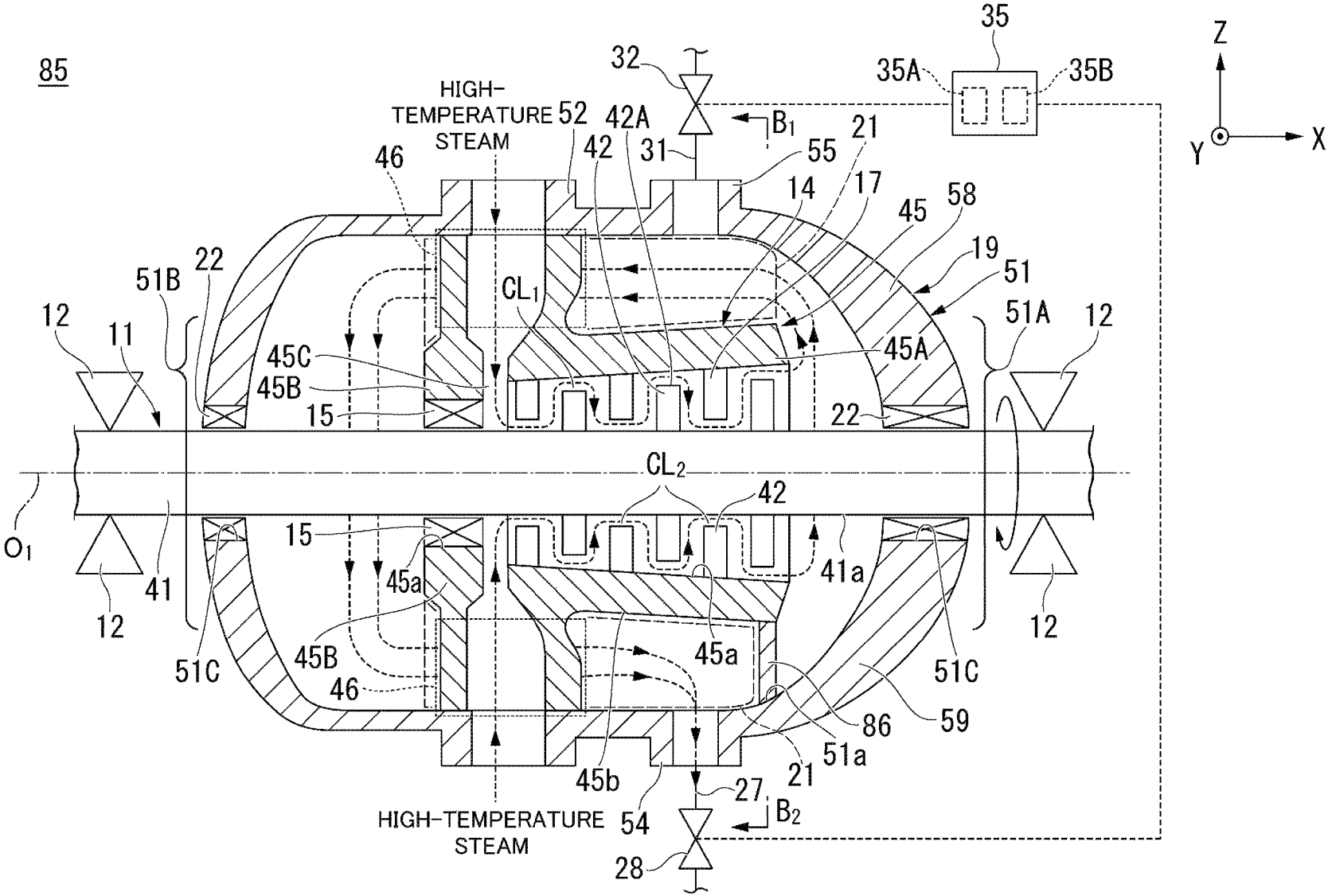
FIG. 10 is a sectional view schematically illustrating a schematic configuration of a steam turbine according to a fourth embodiment of the present invention and is a sectional view illustrating a direction in which exhaust steam flows at the time of the rated operation of the steam turbine.

FIG. 10 is a sectional view schematically illustrating a schematic configuration of a steam turbine according to a fourth embodiment of the present invention and is a sectional view illustrating a direction in which exhaust steam flows at the time of the rated operation of the steam turbine. Dotted arrows in FIG. 10 represent directions in which exhaust steam flows at the time of the rated operation of a steam turbine 85. In FIG. 10, the same components as those in a structure shown in FIG. 1 are given the same symbols.

Figure 11:
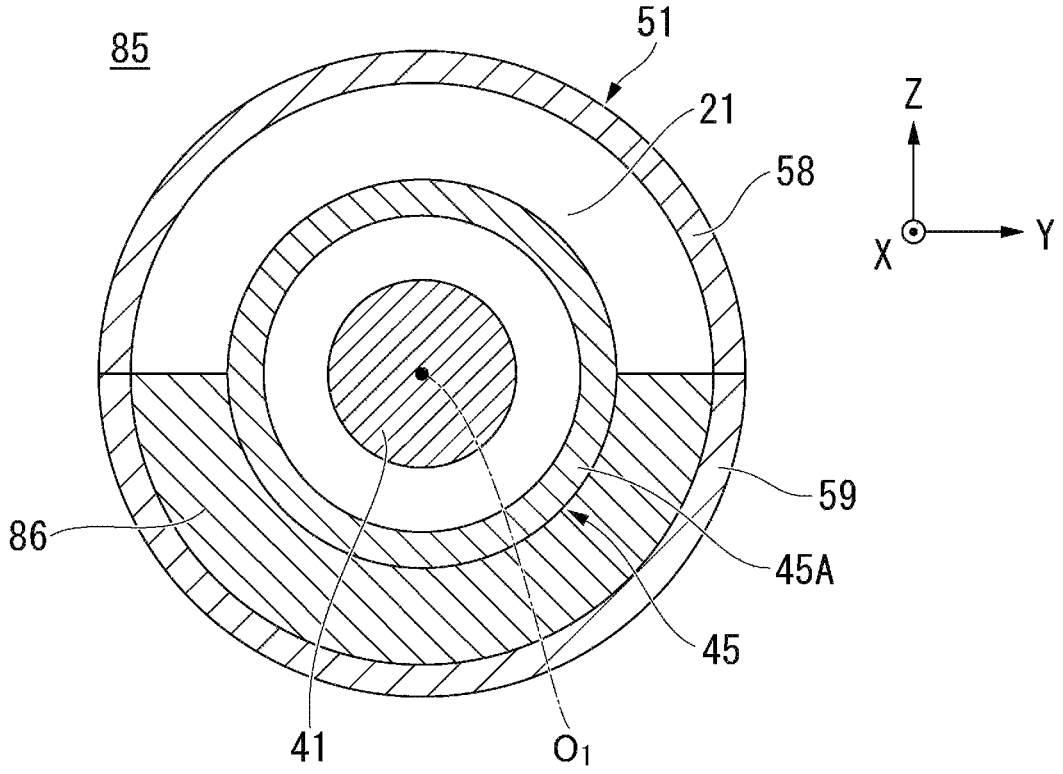
FIG. 11 is a sectional view of the steam turbine shown in FIG. 10 taken along line $B_1$-$B_2$.

FIG. 11 is a sectional view of the steam turbine shown in FIG. 10 taken along line $B_1$-$B_2$. In FIG. 11, the same components as those in a structure shown in FIG. 10 are given the same symbols.

As understood from FIGS. 10 and 11, the steam turbine 85 in the fourth embodiment has the same configuration as the steam turbine 10 except that only one first steam outlet port 54 and only one second steam outlet port 55 are provided, the first steam outlet port 54 is disposed at a position different from that in the steam turbine 10, and a flow path blocking member 86 is provided, the first and second steam outlet ports 54 and 55 constituting the steam turbine 10 in the first embodiment.

The second steam outlet port 55 is disposed in the upper portion 58 of the outer casing main body 51 when being positioned close to the one end 45A of the inner casing main body 45.

The flow path blocking member 86 is a half body obtained by halving a ring-shaped plate member and is connected to the inner circumferential surface 51*a* of the lower portion 59 of the outer casing main body 51 and the outer circumferential surface 45*b* of a lower portion of the inner casing main body 45. The flow path blocking member 86 blocks the flow path 21 (that is, lower portion of flow path 21) disposed in the vicinity of the one end 45A of the lower portion of the inner casing main body 45.

The first steam outlet port 54 is provided in the lower portion 59 of the outer casing main body 51 while being positioned between the flow path blocking member 86 and the steam inlet portion 46 disposed close to the lower portion of the inner casing main body 45.

According to the steam turbine 85 in the fourth embodiment, the second steam outlet port 55 that is disposed in the upper portion 58 of the outer casing main body 51, the flow path blocking member 86 that is disposed in the vicinity of the one end 45A of the lower portion of the inner casing main body 45 and that blocks the lower portion of the flow path 21, and the first steam outlet port 54 that is provided in the lower portion 59 of the outer casing main body 51 while being positioned between the flow path blocking member 86 and the steam inlet portion 46 disposed close to the lower portion of the inner casing main body 45 are provided. Therefore, at the time of the rated operation of the steam turbine 85, exhaust steam that flows toward the lower portion of the flow path 21 immediately after being discharged from the one end 45A of the inner casing main body 45 is blocked by the flow path blocking member 86 and all of the exhaust steam flows to an upper portion of the flow path 21.

Accordingly, only exhaust steam that has passed through the upper portion of the flow path 21 can be discharged to the outside of the outer casing 19 through the first steam outlet port 54 even if the first and second steam outlet ports 54 and 55 are not disposed only in the upper portion 58 of the outer casing main body 51 or only in the lower portion 59 of the outer casing main body 51.

Note that, in the steam turbine 85 in the fourth embodiment as well, it is possible to control the first and second valves 28 and 32 in the same manner as in the first embodiment described above.

In addition, the first and second steam outlet ports 54 and 55 may be disposed to face each other in the Z direction with the axis $O_1$ interposed therebetween.

Furthermore, in the fourth embodiment, a case where the upper portion 58 of the outer casing main body 51 is provided with the second steam outlet port 55 and the lower portion 59 of the outer casing main body 51 is provided with the first steam outlet port 54 has been described as an example. However, a configuration in which the upper portion 58 of the outer casing main body 51 is provided with the first steam outlet port 54, the lower portion 59 of the outer casing main body 51 is provided with the second steam outlet port 55, and the flow path blocking member 86 is disposed to block the upper portion of the flow path 21 may also be adopted.

In addition, the flow path blocking member 86 described in the fourth embodiment may be applied to the steam turbine 65 in the second embodiment.

Fifth Embodiment

Figure 12:
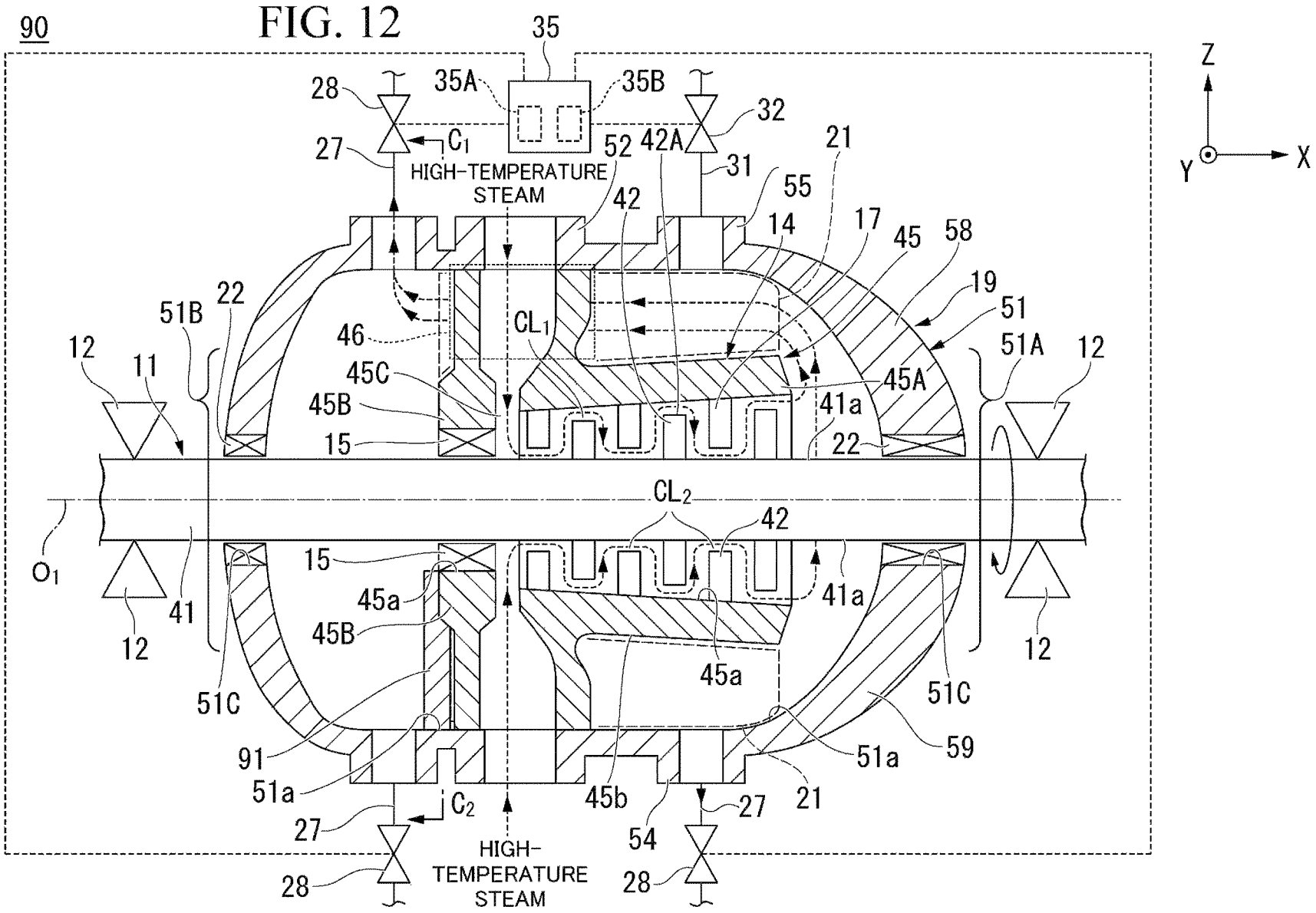
FIG. 12 is a sectional view schematically illustrating a schematic configuration of a steam turbine according to a fifth embodiment of the present invention and is a sectional view illustrating a direction in which exhaust steam flows at the time of the rated operation of the steam turbine.

FIG. 12 is a sectional view schematically illustrating a schematic configuration of a steam turbine according to a fifth embodiment of the present invention and is a sectional view illustrating a direction in which exhaust steam flows at the time of the rated operation of the steam turbine. Dotted arrows in FIG. 12 represent directions in which exhaust steam flows at the time of the rated operation of a steam turbine 90. In FIG. 12, the same components as those in a structure shown in FIG. 1 are given the same symbols.

Figure 13:
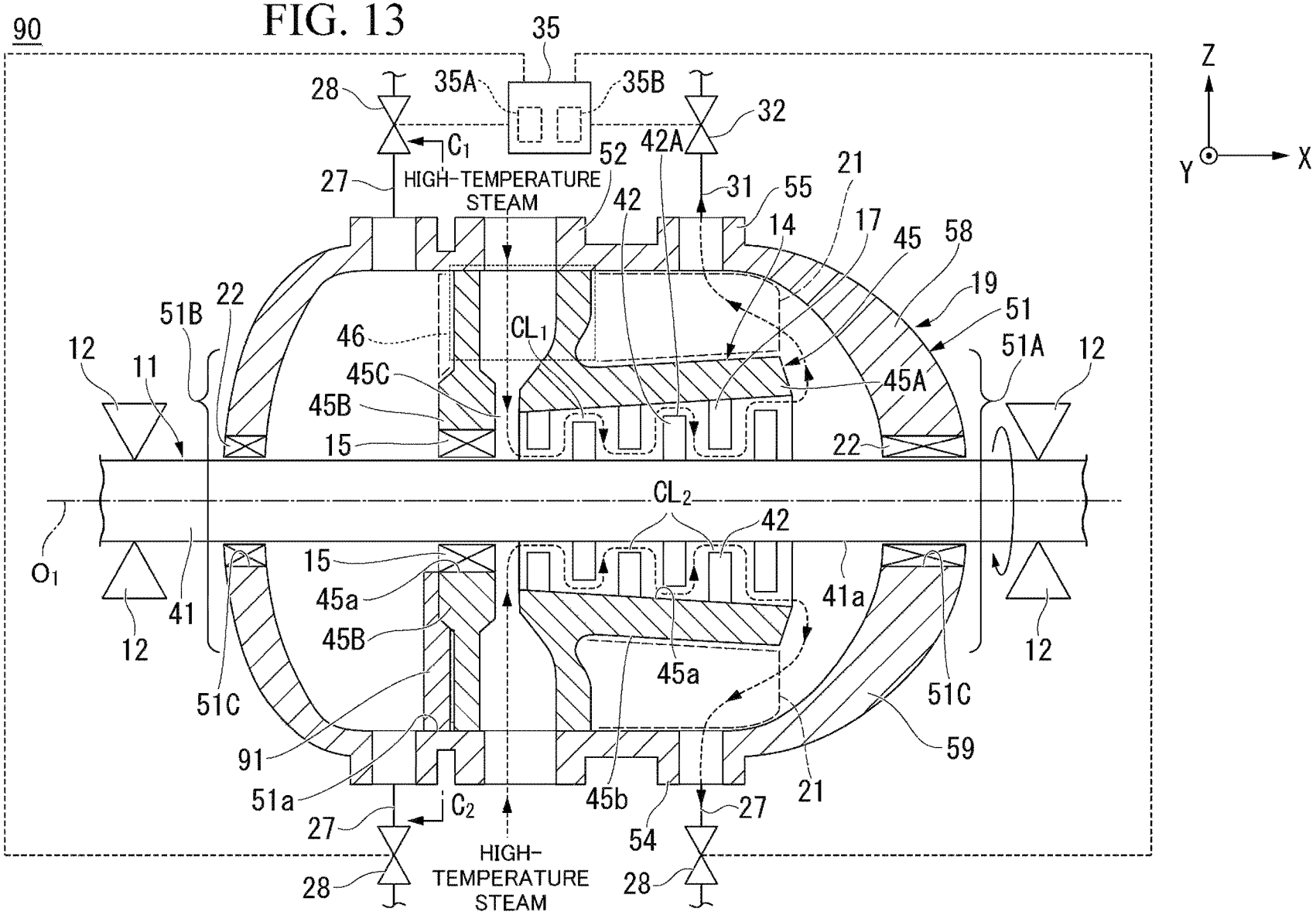
FIG. 13 is a sectional view schematically illustrating a schematic configuration of the steam turbine according to the fifth embodiment of the present invention and is a sectional view illustrating a direction in which exhaust steam flows at the time of transition to stoppage and activation of the steam turbine.

FIG. 13 is a sectional view schematically illustrating a schematic configuration of the steam turbine according to the fifth embodiment of the present invention and is a sectional view illustrating a direction in which exhaust steam flows at the time of transition to stoppage and activation of the steam turbine. Dotted arrows in FIG. 13 represent directions in which exhaust steam flows at the time of transition to stoppage and activation of the steam turbine 90. In FIG. 13, the same components as those in a structure shown in FIG. 12 are given the same symbols.

Figure 14:
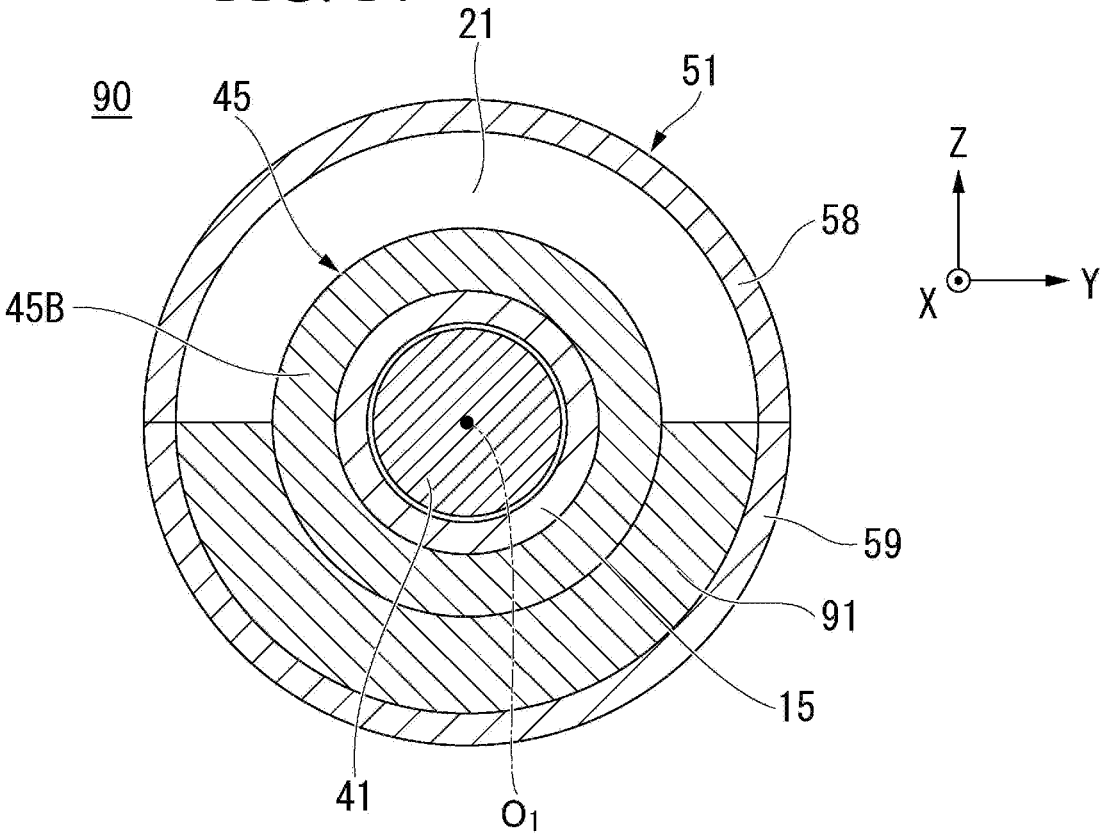
FIG. 14 is a sectional view of the steam turbine shown in FIG. 5 taken along line $C_1$-$C_2$.

FIG. 14 is a sectional view of the steam turbine shown in FIG. 12 taken along line $C_1$-$C_2$. In FIG. 14, the first and second flange portions 56 and 57 shown in FIG. 3 are not shown. In FIG. 14, the same components as those in a structure shown in FIG. 12 are given the same symbols.

As understood from FIGS. 12 to 14, the steam turbine 90 in the fifth embodiment has the same configuration as the steam turbine 10 except that a configuration of the steam turbine 10 in the first embodiment is further provided with a flow rate control member 91.

Therefore, the outer casing 19 of the steam turbine 90 is supported by the frame 25 (refer to FIG. 3) connected to the first flange portion 56 (refer to FIG. 3).

Figure 15:
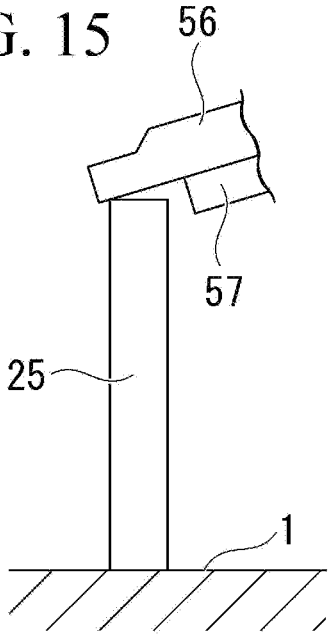
FIG. 15 is a view schematically illustrating a state where the first flange portion is inclined with respect to an upper end of a frame due to thermal expansion of an upper portion of an outer casing main body.

FIG. 15 is a view schematically illustrating a state where the first flange portion is inclined with respect to the upper end of the frame due to thermal expansion of an upper portion of the outer casing main body. In FIG. 15, the same components as those in a structure shown in FIG. 3 are given the same symbols.

As illustrated in FIG. 15, when the upper portion 58 of the outer casing main body 51 is thermal-expanded in a case where the outer casing 19 is supported by the frame 25 (refer to FIG. 3) connected to the first flange portion 56 (refer to FIG. 3), the first flange portion 56 is inclined with respect to the upper end of the frame 25 due to the expansion of the upper portion 58 of the outer casing main body 51.

The flow rate control member 91 is provided between the other end 45B of the lower portion of the inner casing main body 45 and the lower portion 59 of the outer casing. The flow rate control member 91 is a half body obtained by halving a ring-shaped plate member. The flow rate control member 91 has a function of decreasing the flow rate of exhaust steam flowing through the lower portion of the flow path 21 at the time of the rated operation.

According to the steam turbine 90 in the fifth embodiment, since the flow rate control member 91 that decreases the flow rate of exhaust steam flowing through the lower portion of the flow path 21 is provided between the other end 45B of the lower portion of the inner casing main body 45 and the lower portion 59 of the outer casing main body 51, it is possible to make the amount of exhaust steam flowing to the upper portion of the flow path 21 larger than the amount of exhaust steam flowing to the lower portion of the flow path 21.

Accordingly, it is possible to suppress thermal expansion of the upper portion of the outer casing main body 51 and thus it is possible to suppress inclination (state shown in FIG. 15) of the first flange portion 56 with respect to the upper end of the frame 25 which is caused by thermal expansion of the upper portion of the outer casing main body 51.

Note that, in the steam turbine 90 in the fifth embodiment as well, it is possible to control the first and second valves 28 and 32 in the same manner as in the first embodiment described above.

Figure 16:
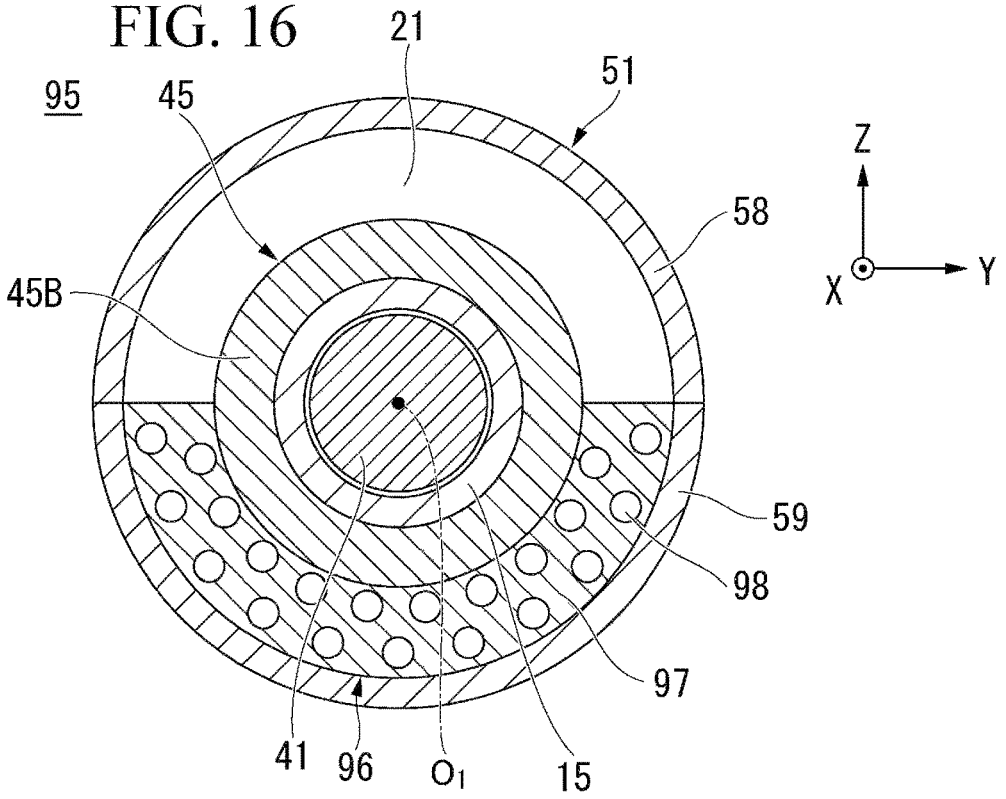
FIG. 16 is a sectional view of a main part of a steam turbine according to a first modification example of the fifth embodiment of the present invention.

FIG. 16 is a sectional view of a main part of a steam turbine according to a first modification example of the fifth embodiment of the present invention. In FIG. 16, the same components as those in a structure shown in FIG. 14 are given the same symbols.

As understood from FIG. 16, a steam turbine 95 in the first modification example of the fifth embodiment has the same configuration as the steam turbine 90 except that a flow rate control member 96 is provided instead of the flow rate control member 91 constituting the steam turbine 90 in the fifth embodiment.

The flow rate control member 96 is provided between the other end 45B of the lower portion of the inner casing main body 45 and the lower portion 59 of the outer casing main body 51. The flow rate control member 96 is provided with a half body 97 obtained by halving a ring-shaped plate member and a plurality of through-holes 98 provided in the half body.

According to the steam turbine 95 in the first modification example of the fifth embodiment, since the flow rate control member 96 as described above is provided, it is possible to achieve the same effect as the steam turbine 90 in the fifth embodiment.

Figure 17:
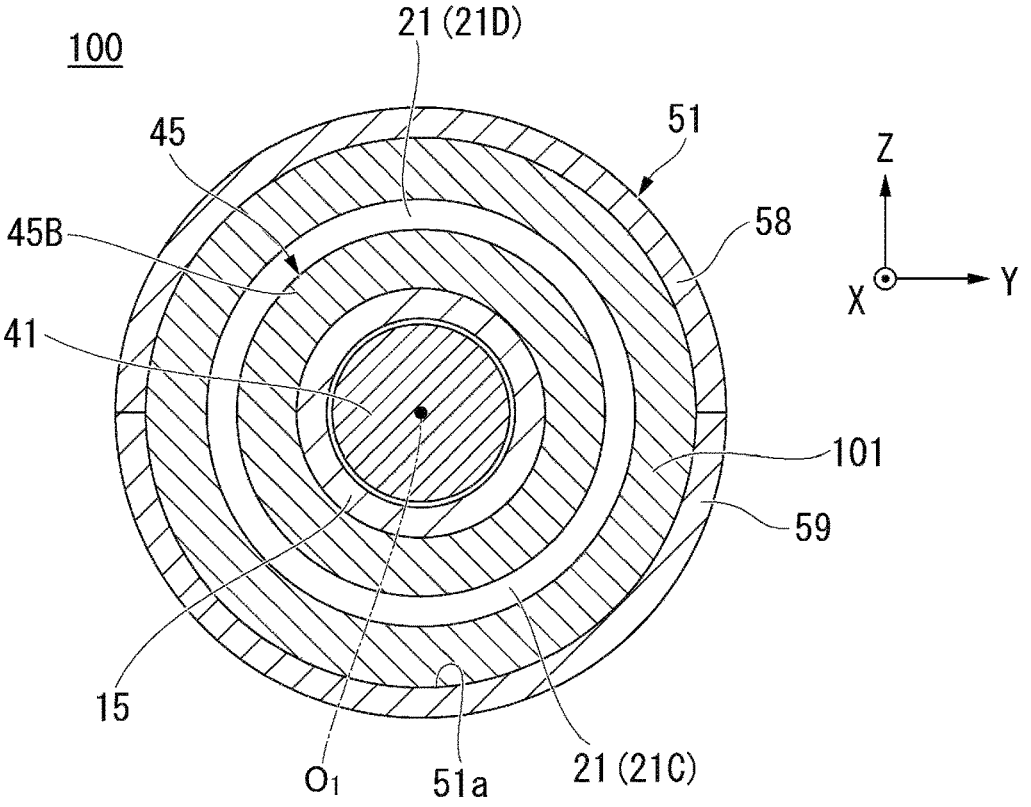
FIG. 17 is a sectional view of a main part of a steam turbine according to a second modification example of the fifth embodiment of the present invention.

FIG. 17 is a sectional view of a main part of a steam turbine according to a second modification example of the fifth embodiment of the present invention. In FIG. 17, the same components as those in a structure shown in FIG. 15 are given the same symbols.

As understood from FIG. 17, a steam turbine 100 in the second modification example of the fifth embodiment has the same configuration as the steam turbine 90 except that a flow rate control member 101 is provided instead of the flow rate control member 91 constituting the steam turbine 90 in the fifth embodiment.

The flow rate control member 101 is provided on the inner circumferential surface 51*a* of the outer casing main body 51 that faces the other end 45B of the inner casing main body 45. The flow rate control member 101 is disposed between the other end 45B of the inner casing main body 45 and the outer casing main body 51. The flow rate control member 101 is a ring-shaped plate member of which the width in a radial direction is not uniform. A portion of the flow rate control member 101 that has a large width is disposed in the upper portion 58 of the outer casing main body 51 and a portion of the flow rate control member 101 that has a small width is disposed in the lower portion 59 of the outer casing main body 51.

According to the steam turbine 100 in the second modification example of the fifth embodiment, since the flow rate control member 101 configured as described above is provided, a portion 21C (corresponding to entrance of flow path 21 for exhaust steam at time of rated operation) of the flow path 21 that is defined by the flow rate control member 101 provided in the lower portion 59 of the outer casing main body 51 and the other end 45B of the lower portion of the inner casing main body 45 is made narrower than a portion 21D (corresponding to entrance of flow path 21 for exhaust steam at time of rated operation) of the flow path 21 that is defined by the flow rate control member 101 provided in the upper portion 58 of the outer casing main body 51 and the other end 45B of the upper portion of the inner casing main body 45 such that the amount of exhaust steam flowing through the lower portion of the flow path 21 at the time of the rated operation can be made smaller than the amount of exhaust steam flowing through the upper portion of the flow path 21. Therefore, it is possible to achieve the same effect as the steam turbine 90 in the fifth embodiment.

Figure 18:
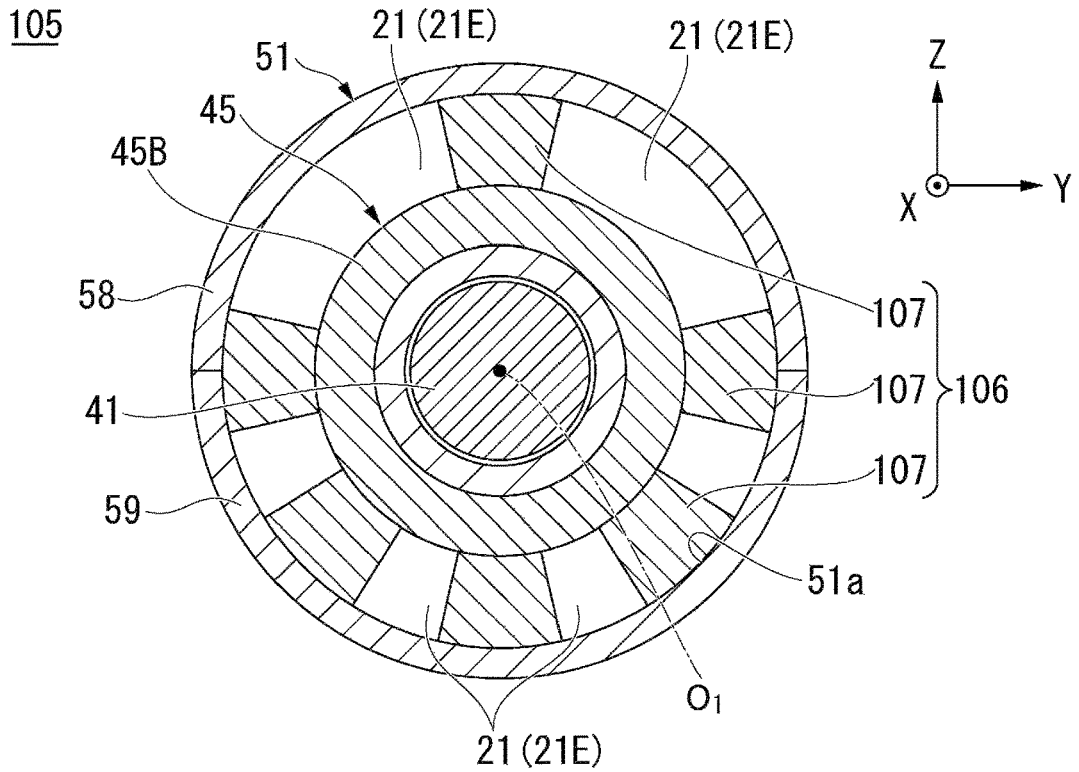
FIG. 18 is a sectional view of a main part of a steam turbine according to a third modification example of the fifth embodiment of the present invention.

FIG. 18 is a sectional view of a main part of a steam turbine according to a third modification example of the fifth embodiment of the present invention. In FIG. 18, the same components as those in a structure shown in FIG. 15 are given the same symbols.

As understood from FIG. 18, a steam turbine 105 in the third modification example of the fifth embodiment has the same configuration as the steam turbine 90 except that a flow rate control member 106 is provided instead of the flow rate control member 91 constituting the steam turbine 90 in the fifth embodiment.

The flow rate control member 106 is provided with a plurality of plate members 107. The plurality of plate members 107 are provided between the outer casing main body 51 and the inner casing main body 45 to connect the inner circumferential surface 51*a* of the outer casing main body 51 and the other end 45B of the inner casing main body 45 to each other.

The plurality of plate members 107 are disposed in a state of being separated from each other in the circumferential direction of the inner casing main body 45. Specifically, the plurality of plate members 107 are disposed such that an interval between the plate members 107 that are positioned to be adjacent to each other in the lower portion 59 of the outer casing main body 51 is made smaller than an interval between the plate members 107 that are positioned to be adjacent to each other in the upper portion 58 of the outer casing main body 51.

According to the steam turbine 105 in the third modification example of the fifth embodiment, since the flow rate control member 106 configured as described above is provided, a portion 21E (corresponding to entrance of flow path 21 for exhaust steam at time of rated operation) of the flow path 21 that is defined by the plurality of plate members 107 disposed in the lower portion 59 of the outer casing main body 51 can be made narrower than a portion 21F (corresponding to entrance of flow path 21 for exhaust steam at time of rated operation) of the flow path 21 that is defined by the plurality of plate members 107 disposed in the upper portion 58 of the outer casing main body 51.

Accordingly, the amount of exhaust steam flowing through the lower portion of the flow path 21 at the time of the rated operation can be made smaller than the amount of exhaust steam flowing through the upper portion of the flow path 21. Therefore, it is possible to achieve the same effect as the steam turbine 90 in the fifth embodiment.

Figure 19:
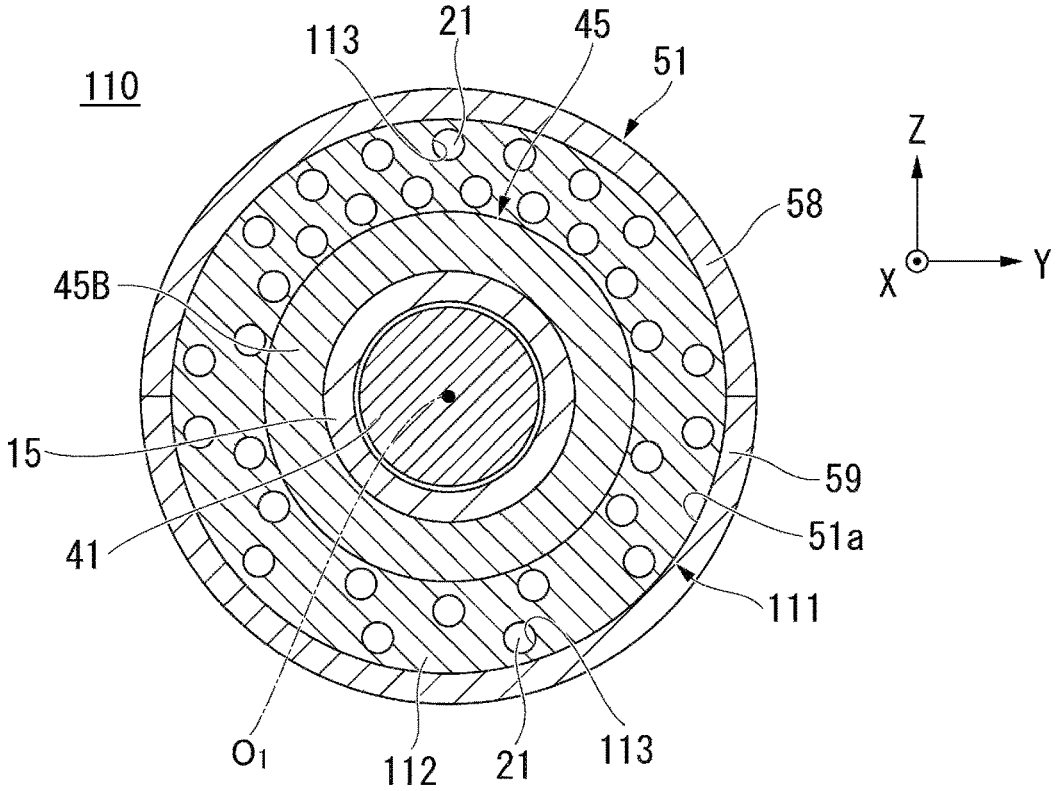
FIG. 19 is a sectional view of a main part of a steam turbine according to a fourth modification example of the fifth embodiment of the present invention.

FIG. 19 is a sectional view of a main part of a steam turbine according to a fourth modification example of the fifth embodiment of the present invention. In FIG. 19, the same components as those in a structure shown in FIG. 15 are given the same symbols.

As understood from FIG. 19, a steam turbine 110 in the fourth modification example of the fifth embodiment has the same configuration as the steam turbine 90 except that a flow rate control member 111 is provided instead of the flow rate control member 91 constituting the steam turbine 90 in the fifth embodiment.

The flow rate control member 111 is provided with a ring-shaped plate member 112 and a plurality of through-holes 113.

The ring-shaped plate member 112 is provided to connect the inner circumferential surface 51*a* of the outer casing main body 51 and the other end 45B of the inner casing main body 45 to each other.

A density at which the plurality of through-holes 113 are formed in a portion of the ring-shaped plate member 112 that is close to the lower portion of the inner casing main body 45 is lower than a density at which the plurality of through-holes 113 are formed in a portion of the ring-shaped plate member 112 that is close to the upper portion of the inner casing main body 45.

According to the steam turbine 110 in the fourth modification example of the fifth embodiment, since the flow rate control member 111 configured as described above is provided, the amount of exhaust steam flowing through the lower portion of the flow path 21 at the time of the rated operation can be made smaller than the amount of exhaust steam flowing through the upper portion of the flow path 21. Therefore, it is possible to achieve the same effect as the steam turbine 90 in the fifth embodiment.

Note that, the above-described flow rate control members 91, 96, 101, 106, and 111 may be applied to the steam turbine 65 in the second embodiment.

In addition, in the fifth embodiment, a case where the first flange portion 56 is supported by the frame 25 as illustrated in FIG. 3 has been described as an example. However, in a case where the second flange portion 57 is supported by the frame 25, the flow rate control members 91, 96, 101, 106, and 111 may be used in a state of being inverted. According to this configuration, it is possible to achieve the same effect as the steam turbine 90 in the fifth embodiment.

Sixth Embodiment

Figure 20:
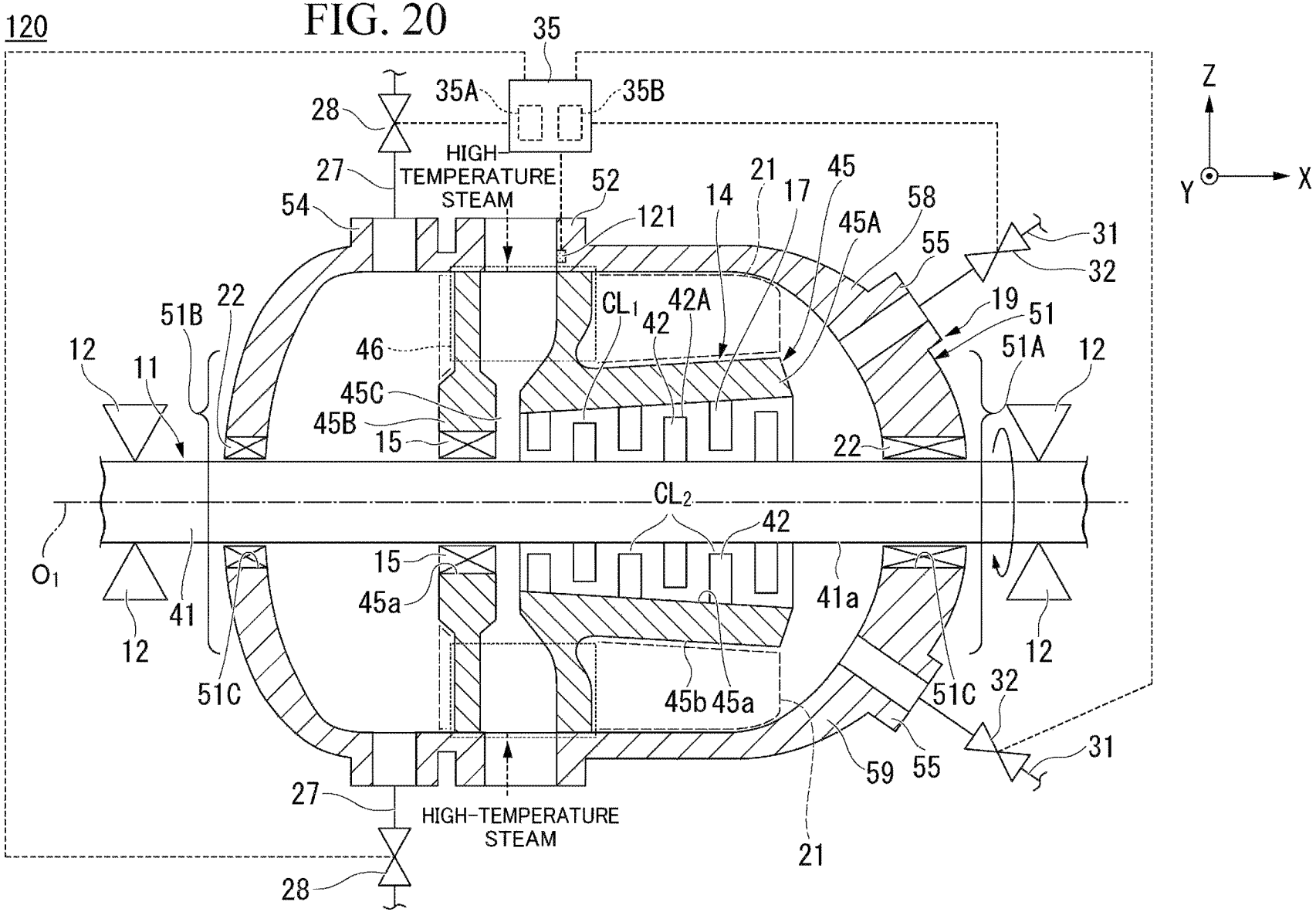
FIG. 20 is a sectional view of a steam turbine according to a sixth embodiment of the present invention.

FIG. 20 is a sectional view of a steam turbine according to a sixth embodiment of the present invention. In FIG. 20, the same components as those in a structure shown in FIG. 4 are given the same symbols.

As understood from FIG. 20, a steam turbine 120 in the sixth embodiment has the same configuration as the steam turbine 65 except that a configuration of the steam turbine 65 in the second embodiment is further provided with a temperature measuring unit 121 and the control unit 35 performs opening-and-closing control of the first and second valves 28 and 32 based on a temperature measured by the temperature measuring unit 121.

The temperature measuring unit 121 is provided in the steam inlet port 52. The temperature measuring unit 121 is electrically connected to the control unit 35. The temperature measuring unit 121 consecutively measures the temperature of the steam inlet port 52 and consecutively transmits the measured temperature to the control unit 35.

Since the temperature of the steam inlet port 52 is measured in this manner, it is possible to estimate the temperature of exhaust steam based on the temperature of the steam inlet port 52.

Figure 21:
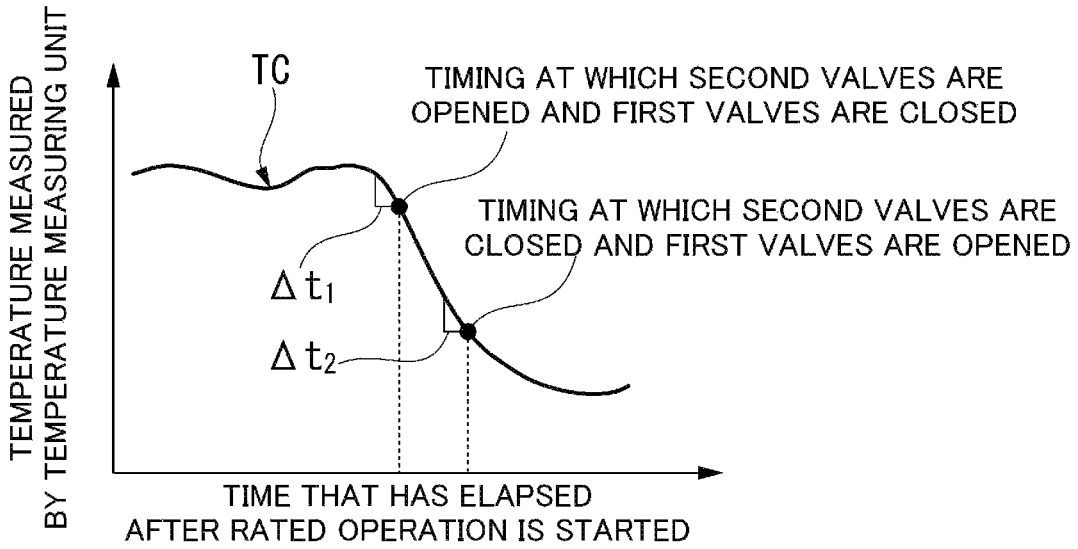
FIG. 21 is a diagram for describing a temperature curve drawn by a calculation unit of a control unit.

FIG. 21 is a diagram for describing a temperature curve drawn by the calculation unit of the control unit. In FIG. 21, "$\Delta t_1$ and $\Delta t_2$" represent predetermined times (hereinafter, referred to as time $\Delta t_1$ and time $\Delta t_2$) and "TC" represents the temperature curve (hereinafter, referred to as temperature curve TC) drawn by the calculation unit 35B of the control unit 35, respectively.

The calculation unit 35B of the control unit 35 draws the temperature curve TC based on the temperature measured by the temperature measuring unit 121 and controls opening and closing of the first and second valves 28 and 32 based on times $t_1$ and $t_2$ that are input into the storage unit 35A in advance, a predetermined slope $S_1$ which is a threshold value at the time $t_1$, and a predetermined slope $S_2$ which is a threshold value at the time $t_2$.

Figure 22:
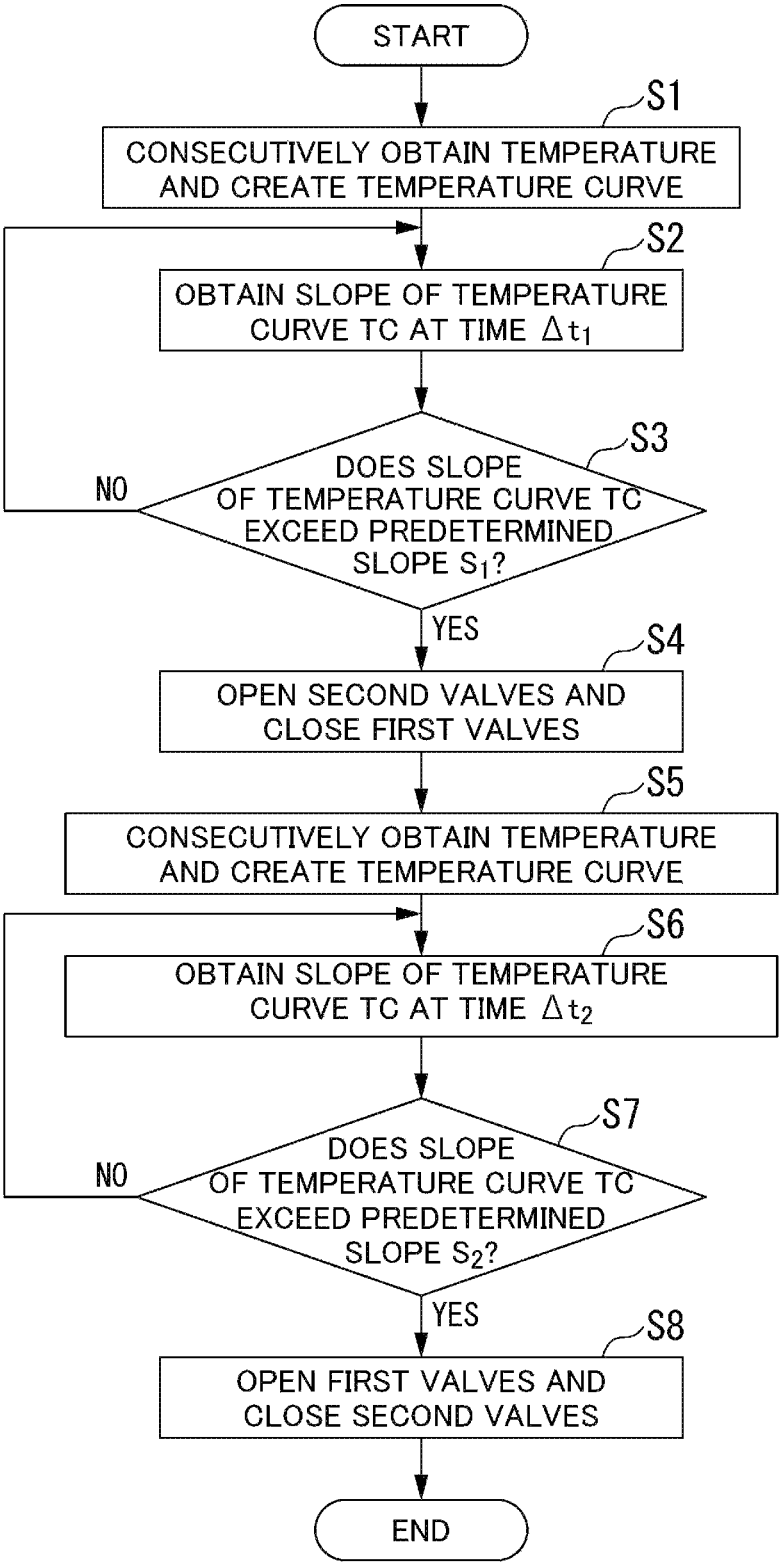
FIG. 22 is a flowchart related to opening and closing of first and second valves of the steam turbine according to the sixth embodiment of the present invention.

FIG. 22 is a flowchart related to opening and closing of the first and second valves of the steam turbine according to the sixth embodiment of the present invention.

Here, opening-and-closing control of the first and second valves 28 and 32 of the steam turbine 120 will be described with reference to FIG. 22.

First, when a process in the flowchart shown in FIG. 22 is started, the temperature measuring unit 121 consecutively measures the temperature of the steam inlet port 52 and consecutively transmits the measured temperature to the control unit 35 in S1. The calculation unit 35B of the control unit 35 creates the temperature curve TC as described with reference to FIG. 21 based on the temperature measured by the temperature measuring unit 121.

Next, in S2, the calculation unit 35B obtains the slope of the temperature curve TC at the time $\Delta t_1$, that is, a decrease rate of the temperature measured by the temperature measuring unit 121, through calculation.

Next, in S3, it is determined whether the slope of the temperature curve TC obtained in S2 exceeds the predetermined slope $S_1$ or not. When it is determined that the slope of the temperature curve TC exceeds the predetermined slope $S_1$ (determination of Yes) in S3, the process proceeds to S4. When it is determined that the slope of the temperature curve TC does not exceed the predetermined slope $S_1$ (determination of No) in S3, the process returns to S2.

Next, in S4, the second valves 32 are opened and the first valves 28 are closed. The process is performed in at least one of a period at which transition from the rated operation state to operation stoppage is performed and a period between when activation is performed at the operation stoppage time and when the rated operation is reached.

Next, in S5, the same process as that in S1 described above is performed.

Next, in S6, the calculation unit 35B obtains the slope of the temperature curve TC at the time $\Delta t_2$ through calculation.

Next, in S7, it is determined whether the slope of the temperature curve TC obtained in S6 exceeds the predetermined slope $S_2$ or not. When it is determined that the slope of the temperature curve TC exceeds the predetermined slope $S_2$ (determination of Yes) in S7, the process proceeds to S8. When it is determined that the slope of the temperature curve TC does not exceed the predetermined slope $S_2$ (determination of No) in S7, the process returns to S6.

Next, in S8, the first valves 28 are opened and the second valves 32 are closed. This process is performed at the time of the rated operation.

A process of switching the first and second valves 28 and 32 is performed by repeating the above-described process.

According to the steam turbine 120 in the sixth embodiment, since the temperature measuring unit 121 and the control unit 35 as described above are provided, it is possible to control the first and second valves 28 and 32 based on the temperature of the steam inlet port 52 measured by the temperature measuring unit 121. Therefore, it is possible to improve an effect of suppressing contact between the stator vanes 17 and the rotor main body 41 and contact between the rotor blades 42 and the inner casing main body 45 at the time of the rated operation, the transition to stoppage, and the activation.

In addition, since the direction of steam flow is switched while accurately detecting that the temperature of the outer casing 19, the inner casing 14, or the rotor 11 is in a state of being decreased by using the slope of the temperature of the steam inlet port 52, it is possible to suppress excessive reduction in size of the first and second clearances $CL_1$ and $CL_2$, which occurs because the outer casing 19 and the inner casing 14 of which the thermal capacity is low is cooled earlier than the rotor 11 of which the thermal capacity is high and to further improve an effect of suppressing contact between the stator vanes 17 and the rotor main body 41 and contact between the rotor blades 42 and the inner casing 14.

Note that, in the sixth embodiment, a case where the temperature measuring unit 121 that measures the temperature of the steam inlet port 52 is provided has been described as an example. However, it is sufficient that the temperature measuring unit 121 is disposed to be able to measure at least one of the temperature of the steam inlet port 52, the temperature of the first steam outlet port 54, the temperature of the second steam outlet port 55, the temperature of the inner casing main body 45, the temperature of exhaust steam inside the outer casing main body 51, and the temperature of the outer casing main body 51.

In a case where the temperature measuring unit 121 disposed as described is used as well, it is possible to achieve the same effect as the steam turbine 120 in the sixth embodiment.

Seventh Embodiment

Figure 23:
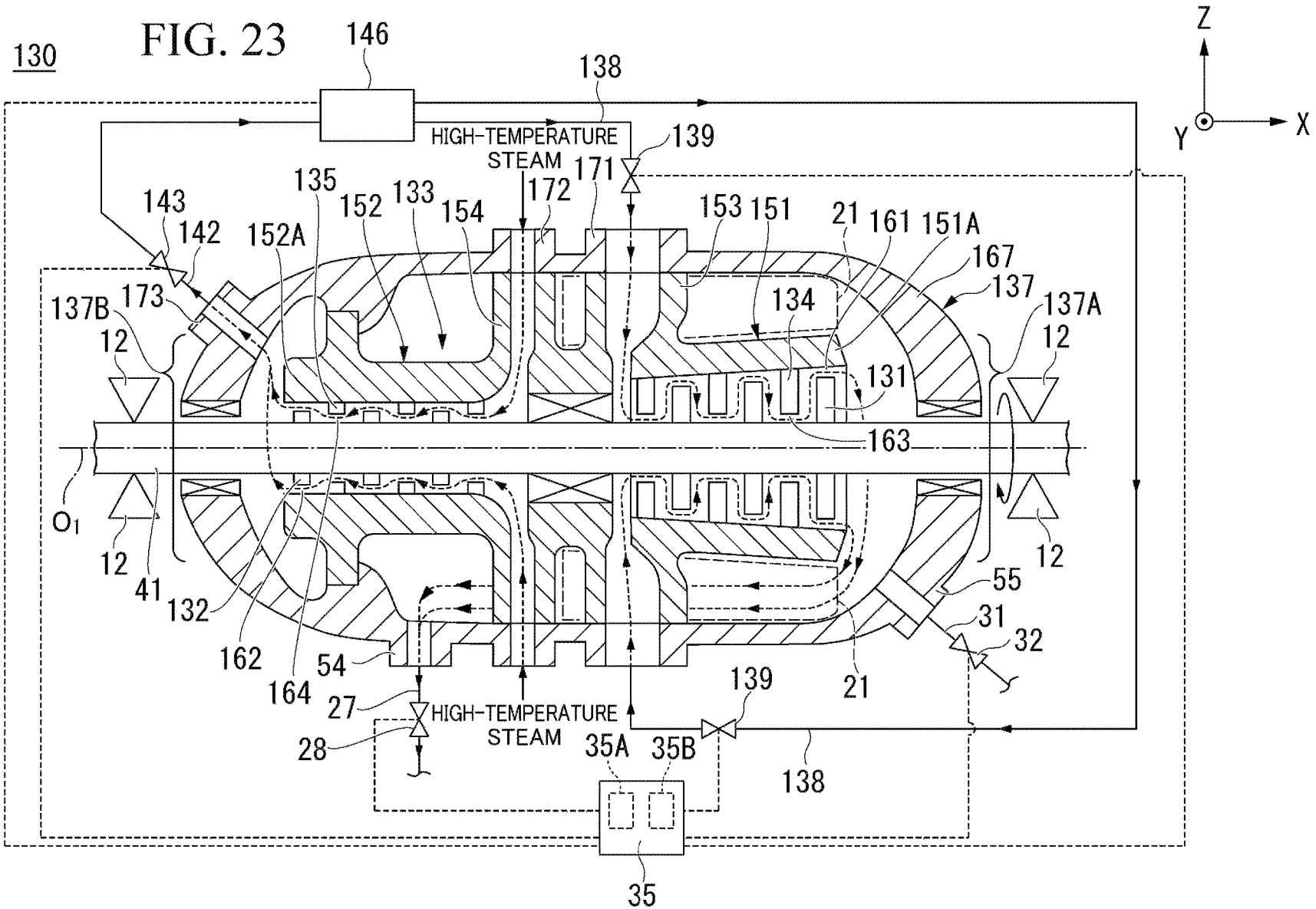
FIG. 23 is a sectional view schematically illustrating a schematic configuration of a steam turbine according to a seventh embodiment of the present invention and is a sectional view illustrating a direction in which exhaust steam flows at the time of the rated operation of the steam turbine.

FIG. 23 is a sectional view schematically illustrating a schematic configuration of a steam turbine according to a seventh embodiment of the present invention and is a sectional view illustrating a direction in which exhaust steam flows at the time of the rated operation of the steam turbine. Dotted arrows in FIG. 23 represent directions in which exhaust steam flows at the time of the rated operation of a steam turbine 130. In FIG. 23, the same components as those in the steam turbine 65 in the second embodiment that is shown in FIG. 4 are given the same symbols.

Figure 24:
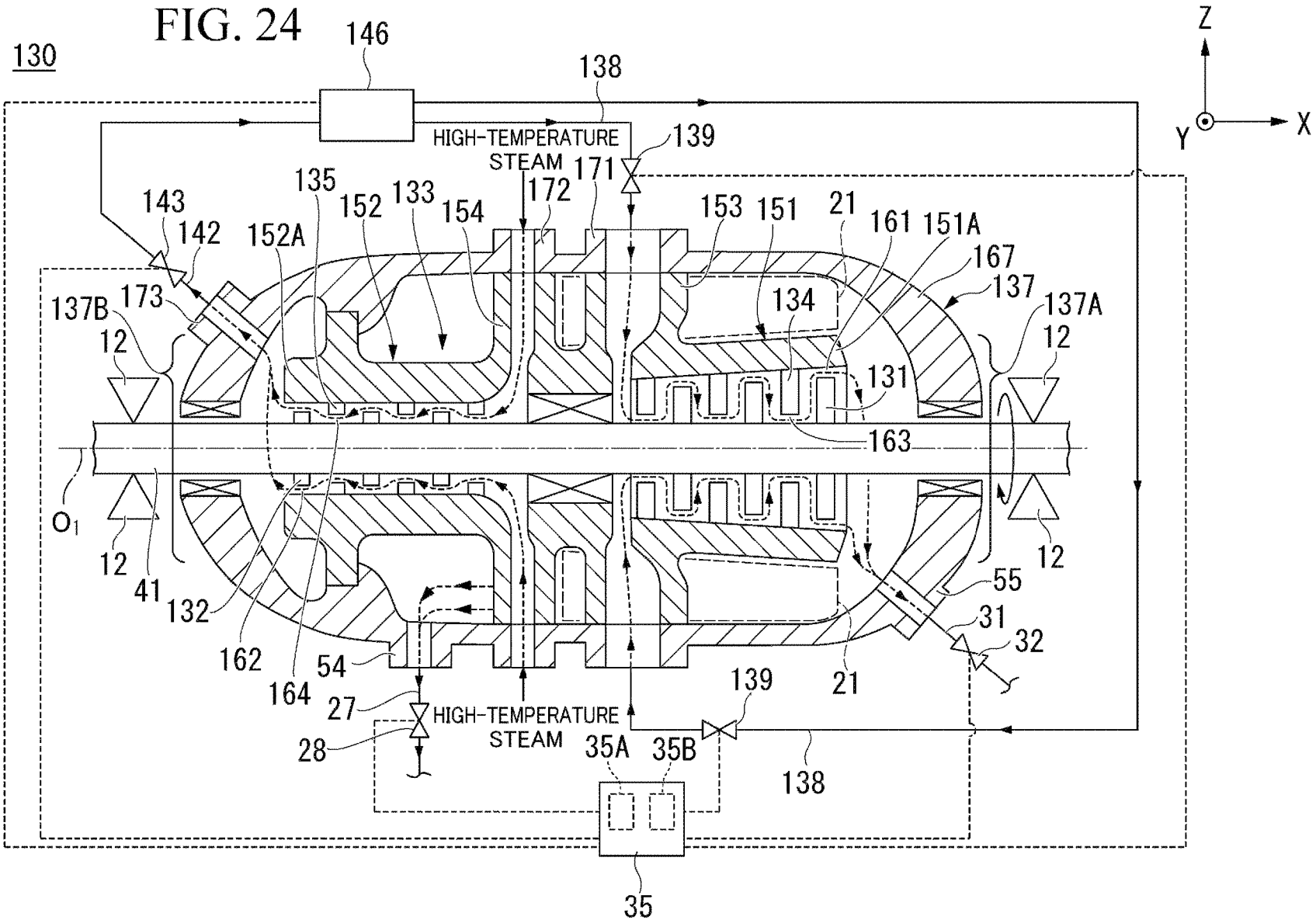
FIG. 24 is a sectional view schematically illustrating a schematic configuration of the steam turbine according to the seventh embodiment of the present invention and is a sectional view illustrating a direction in which exhaust steam flows at the time of transition to stoppage and activation of the steam turbine.

FIG. 24 is a sectional view schematically illustrating a schematic configuration of the steam turbine according to the seventh embodiment of the present invention and is a sectional view illustrating a direction in which exhaust steam flows at the time of transition to stoppage and activation of the steam turbine. Dotted arrows in FIG. 24 represent directions in which exhaust steam flows at the time of transition to stoppage and activation of the steam turbine 130. In FIG. 24, the same components as those in the steam turbine 65 in the second embodiment that is shown in FIG. 4 are given the same symbols.

As understood from FIGS. 22 and 24, the steam turbine 130 in the seventh embodiment is provided with rotor blades 131 and 132, an inner casing 133, stator vanes 134 and 135, and an outer casing 137 instead of the rotor blades 42, the inner casing 14, the stator vanes 17, and the outer casing 19 and is further provided with a reheat steam inlet line 138, a third valve 139, an exhaust steam outlet line 142, a fourth valve 143, and a reheating unit 146.

The rotor blades 131 are provided on one side of the rotor main body 41. The rotor blades 132 are provided on the other side of the rotor main body 41.

The inner casing 133 is accommodated in the outer casing 137. The inner casing 133 is provided with a first casing main body portion 151, a second casing main body portion 152, a first steam inlet portion 153, and a second steam inlet portion 154.

The first and second casing main bodies 151 and 152 accommodate the rotor main body 41.

An inner circumferential surface of the first casing main body portion 151 faces the rotor blades 131 with a first clearance 161 interposed therebetween. Middle-pressure steam (reheat steam), which is first steam having a first pressure, is introduced into the first casing main body portion 151 and the middle-pressure steam is discharged as exhaust steam from one end 151A disposed close to one end 137A of the outer casing 137.

The flow path 21 is disposed between an outer circumferential surface of the first casing main body portion 151 and the outer casing 137.

An inner circumferential surface of the second casing main body portion 152 faces the rotor blades 132 with a first clearance 162 interposed therebetween. High-pressure steam, which is second steam having a second pressure higher than the first pressure, is introduced into the second casing main body portion 152 and the high-pressure steam is discharged as the second exhaust steam from one end 152A disposed close to the other end 137B of the outer casing 137.

The first steam inlet portion 153 is provided between the first casing main body portion 151 and the outer casing 137. Through the first steam inlet portion 153, the middle-pressure steam is introduced into the first casing main body portion 151.

The second steam inlet portion 154 is provided between the second casing main body portion 152 and the outer casing 137. Through the second steam inlet portion 154, the high-pressure steam is introduced into the second casing main body portion 152.

The stator vanes 134 are provided on the inner circumferential surface of the first casing main body portion 151 and face an outer circumferential surface of the rotor main body 41 with a second clearance 163 interposed therebetween. The stator vanes 135 are provided on the inner circumferential surface of the second casing main body portion 152 and face the outer circumferential surface of the rotor main body 41 with a second clearance 164 interposed therebetween.

The outer casing 137 is provided with an outer casing main body 167 that accommodates the inner casing 133 and is provided with the first steam outlet port 54, the second steam outlet port 55, a first steam inlet port 171, a second steam inlet port 172, and a third steam outlet port 173 provided in the outer casing main body 167.

A portion of a lower portion of the outer casing main body 167 that faces the second casing main body portion 152 is provided with the first steam outlet port 54.

A portion of the lower portion of the outer casing main body 167 that is close to the one end 137A of the outer casing 137 is provided with the second steam outlet port 55.

A portion of an upper portion of the outer casing main body 167 that faces the first steam inlet portion 153 is provided with the first steam inlet port 171. Through the first steam inlet port 171, the middle-pressure steam is introduced into the first casing main body portion 151 via the first steam inlet portion 153.

A portion of the upper portion of the outer casing main body 167 that faces the second steam inlet portion 154 is provided with the second steam inlet port 172. Through the second steam inlet port 172, the high-pressure steam is introduced into the second casing main body portion 152 via the second steam inlet portion 154.

A portion of the upper portion of the outer casing main body 167 that is close to the other end 137B of the outer casing 137 is provided with the third steam outlet port 173. Through the third steam outlet port 173, the second exhaust steam discharged from the one end 152A of the second casing main body portion 152 is discharged to the outside of the outer casing 137.

One end of the reheat steam inlet line 138 is connected to the reheating unit 146 and the other end thereof is connected to the first steam inlet port 171. Through the reheat steam inlet line 138, the middle-pressure steam (first steam) supplied from the reheating unit 146 is supplied into the first casing main body portion 151 via the first steam inlet port 171.

The reheat steam inlet line 138 is provided with the third valve 139 and the third valve 139 is electrically connected to the control unit 35. When the third valve 139 is opened, the middle-pressure steam is supplied into the first casing main body portion 151 and when the third valve 139 is closed, supply of the middle-pressure steam to the inside of the first casing main body portion 151 is stopped.

As the third valve 139, for example, an on-off valve or a flow rate adjustment valve can be used.

One end of the exhaust steam outlet line 142 is connected to the third steam outlet port 173 and the other end thereof is connected to the reheating unit 146. Through the exhaust steam outlet line 142, the second exhaust steam (high-pressure steam lowered in temperature and pressure) is supplied to the reheating unit 146.

The exhaust steam outlet line 142 is provided with the fourth valve 143. The fourth valve 143 is electrically connected to the control unit 35. When the fourth valve 143 is opened, the second exhaust steam is supplied into the reheating unit 146 and when the fourth valve 143 is closed, supply of the second exhaust steam to the reheating unit 146 is stopped.

As the fourth valve 143, for example, an on-off valve or a flow rate adjustment valve can be used.

The reheating unit 146 heats the second exhaust steam to generate the middle-pressure steam and the middle-pressure steam is discharged to the reheat steam inlet line 138 as the first steam.

As illustrated in FIG. 22, at the time of the rated operation of the steam turbine 130, the high-pressure steam, which is the second steam, is supplied into the second casing main body portion 152 and the second exhaust steam discharged from the one end 152A of the second casing main body portion 152 is supplied to the reheating unit 146.

Then, the middle-pressure steam, which is the first steam, is supplied into the first casing main body portion 151 from the reheating unit 146 and the first exhaust steam is discharged from the one end 151A of the first casing main body portion 151. The first exhaust steam passes through the lower portion of the flow path 21 while cooling the first casing main body portion 151 and the outer casing main body 167 defining the flow path 21.

The first exhaust steam that has passed through the entire length of the flow path 21 is discharged to the outside of the outer casing 137 via the first steam outlet port 54.

As illustrated in FIG. 24, at the time of transition to stoppage and at the time of activation, the high-pressure steam, which is the second steam, is supplied into the second casing main body portion 152 and the second exhaust steam discharged from the one end 152A of the second casing main body portion 152 is supplied to the reheating unit 146.

Then, the middle-pressure steam, which is the first steam, is supplied into the first casing main body portion 151 from the reheating unit 146 and the first exhaust steam is discharged from the one end 151A of the first casing main body portion 151. The first exhaust steam is discharged to the outside of the outer casing 137 through the second steam outlet port 55 without passing through the flow path 21.

According to the steam turbine 130 in the seventh embodiment, even in a case where the inner casing 133 is provided with the first casing main body portion 151 into which the first steam having the first pressure is introduced and from which the first steam is discharged as the first exhaust steam through the one end thereof and the second casing main body portion 152 into which the second steam having the second pressure higher than the first pressure is supplied and from which the second steam is discharged as the second exhaust steam through the one end thereof, it is possible to suppress contact between the stator vanes 134 and 135, rotor main body 41, and the rotor blades 131 and 132 and contact between the rotor blades 131 and 132 and the first and second casing main bodies 151 and 152 at the time of the rated operation, the transition to stoppage, and the activation while improving energy conversion efficiency at the time of the rated operation.

Note that, in the seventh embodiment, as the first and second valves 28 and 32, for example, the control unit 35 performs control such that the first valve 28 is opened (fully opened) and the second valve 32 is closed (fully closed) at the time of the rated operation and performs control such that the first valve 28 is closed (fully closed) and the second valve 32 is opened (fully opened) at the time of the transition to stoppage and at the time of the activation.

Additionally, in the seventh embodiment, in a case where flow rate adjustment valves are used as the first and second valves 28 and 32, for example, an operation of discharging an amount of first exhaust steam larger than a half of the first exhaust steam flowing through the entire length of the flow path 21 to the outside of the outer casing 137 via the first steam outlet port 54 at the time of rated operation and an operation of discharging an amount of first exhaust steam larger than a half of the first exhaust steam flowing through a portion of the flow path 21 or all of the first exhaust steam not flowing through the flow path to the outside of the outer casing 137 via the second steam outlet port 55 at the time of transition to stoppage and the time of activation are automatically controlled.

Note that, in the seventh embodiment, a case where the middle-pressure steam is used as the first steam having the first pressure and the high-pressure steam is used as the second steam having the second pressure higher than the first pressure has been described as an example. However, the first steam and the second steam are not limited thereto.

Eighth Embodiment

Figure 25:
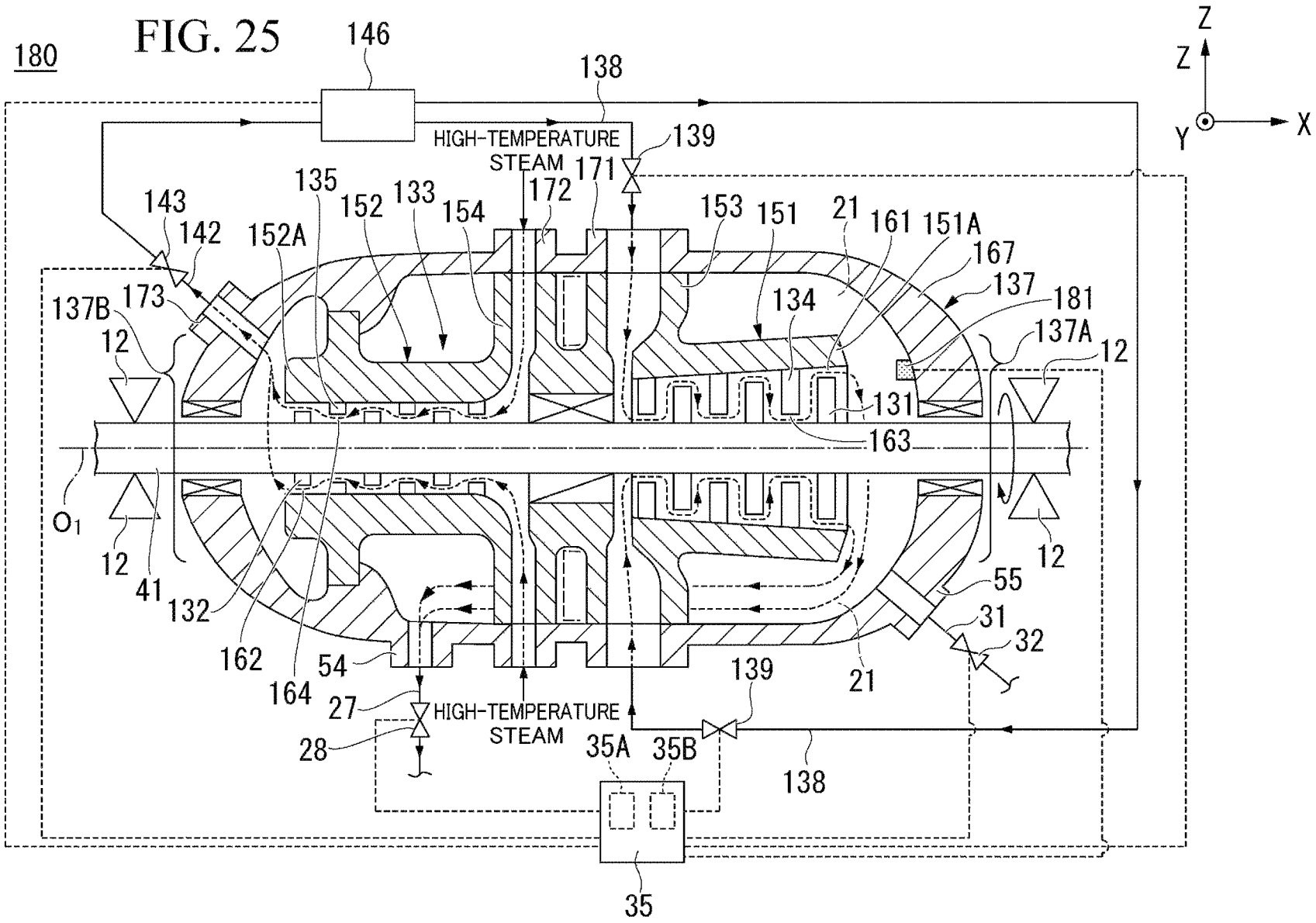
FIG. 25 is a sectional view illustrating a schematic configuration of a steam turbine according to an eighth embodiment of the present invention.

FIG. 25 is a sectional view illustrating a schematic configuration of a steam turbine according to an eighth embodiment of the present invention. In FIG. 25, the same components as those in a structure shown in FIG. 23 are given the same symbols.

As understood from FIG. 25, a steam turbine 180 in the eighth embodiment has the same configuration as the steam turbine 130 except that a configuration of the steam turbine 130 in the seventh embodiment further includes a clearance measuring unit 181 and flow rate adjustment valves are used as the first and second valves 28 and 32.

The clearance measuring unit 181 is provided inside the outer casing main body 167 and is electrically connected to the control unit 35.

The clearance measuring unit 181 measures the value of at least one of the first and second clearances 161 to 164 and consecutively transmits the measured clearance value to the control unit 35. As the clearance measuring unit 181, for example, a laser-type measuring instrument can be used.

The control unit 35 adjusts the opening of the first and second valves 28 and 32 based on the clearance value transmitted from the clearance measuring unit 181.

Figure 26:
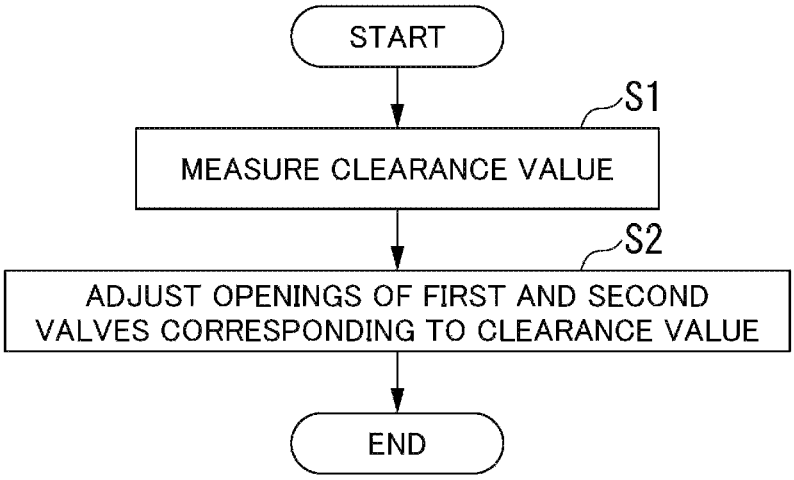
FIG. 26 is a flowchart for describing adjustment of the opening of the first and second valves which is performed by the control unit.
Figure 27:
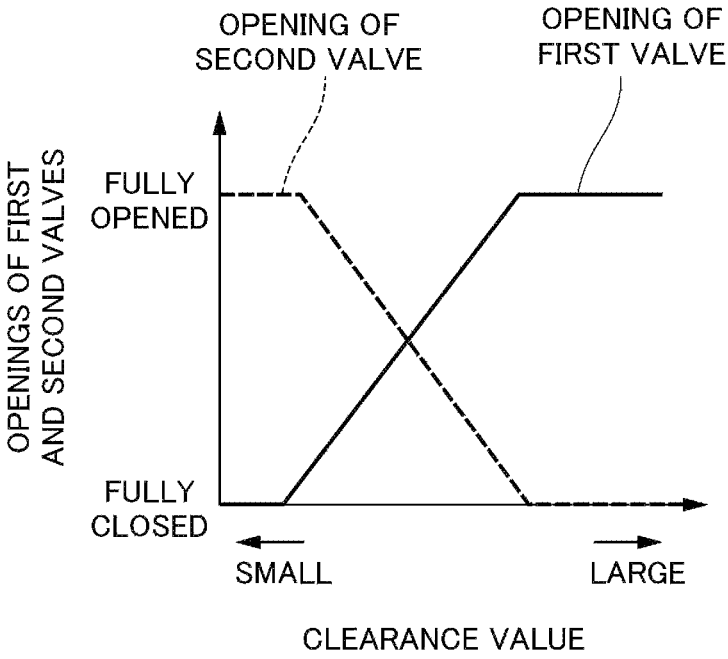
FIG. 27 is a graph illustrating a relationship between the opening of the first and second valves and a clearance value.

FIG. 26 is a flowchart for describing adjustment of the opening of the first and second valves which is performed by the control unit. FIG. 27 is a graph illustrating a relationship between the opening of the first and second valves and the clearance value.

Here, a method of adjustment of the opening of the first and second valves 28 and 32 which is performed by the control unit 35 will be described with reference to FIGS. 26 and 27.

When a process shown in FIG. 26 is started, in 51, the value of at least one of the first and second clearances 161 to 164 is measured by the clearance measuring unit 181 and the clearance value measured by the clearance measuring unit 181 is consecutively transmitted to the control unit 35.

Next, in S2, based on the graph shown in FIG. 27 and the measured clearance value, the control unit 35 adjusts the opening of the first and second valves 28 and 32 such that the opening of the first and second valves 28 and 32 become desired opening.

According to the steam turbine 180 in the eighth embodiment, it is possible to automatically and controllably control the opening of the first and second valves 28 and 32 by repeating the processes in S1 and S2 described above.

Although the preferred embodiments of the present invention have been described in detail above, the present invention is not limited to such specific embodiments and various kinds of variations and modifications can be made without departing from the gist of the present invention as described in the claims.

INDUSTRIAL APPLICABILITY

The present invention can be applied to a steam turbine.

REFERENCE SIGNS LIST

1 floor
10, 65, 70, 75, 80, 85, 90, 95, 100, 105, 110, 120, 130, 180 steam turbine
11 rotor
12 bearing
14, 133 inner casing
15, 22 seal member
17, 134, 135 stator vane
17A, 42A tip end
19, 137 outer casing
21 flow path
21A, 21B entrance
21C, 21D, 21E, 21F portion
25 frame
27 first outlet line
28 first valve
31 second outlet line
32 second valve
35 control unit
35A storage unit
35B calculation unit
41 rotor main body
41*a*, 45*b* outer circumferential surface
42, 131, 132 rotor blade
45 inner casing main body
45*a*, 51*a* inner circumferential surface

45A, 51A, 137A, 151A, 152A one end
45B, 51B, 137B other end
45C steam inlet hole
46 steam inlet portion
51, 167 outer casing main body
51C rotor insertion hole
52 steam inlet port
54 first steam outlet port
55 second steam outlet port
56 first flange portion
57 second flange portion
58 upper portion
59 lower portion
71, 76, 81 flow path entrance adjustment member
78 plate portion
81A, 98, 113 through-hole
86 flow path blocking member
97 half body
91, 96, 101, 106, 111 flow rate control member
107, 112 plate member
121 temperature measuring unit
139 third valve
142 exhaust steam outlet line
143 fourth valve
146 reheating unit
151 first casing main body
152 second casing main body
153 first steam inlet portion
154 second steam inlet portion
161, 162 first clearance
163, 164 second clearance
171 first steam inlet port
172 second steam inlet port
173 third steam outlet port
181 clearance measuring unit
$O_1$ axis
$CL_1$ first clearance
$CL_2$ second clearance

The invention claimed is:

1. A steam turbine comprising:
a rotor that is configured to rotate around an axis;
an inner casing that is provided with
an inner casing main body, which accommodates the rotor and into which steam introduced thereto is discharged as exhaust steam from a first end in a direction along the axis, and
a steam inlet portion, which is provided on an outer side of the inner casing main body and through which the steam is introduced into the inner casing main body;
an outer casing that is provided with
an outer casing main body, which accommodates the inner casing and which defines a flow path that extends in the direction along the axis between the outer casing main body and an outer circumferential surface of the inner casing main body and through which the exhaust steam flows, the outer casing main body having a first end in the direction along the axis and an opposite second end in the direction along the axis,
a steam inlet port provided on the outer casing main body and configured to introduce the steam into the steam inlet portion,
a first steam outlet port, which is provided in the outer casing main body and through which the exhaust steam flowing through an entire length of the flow path in the direction along the axis is discharged to an outside, and
a second steam outlet port, which is provided in the outer casing main body and through which the exhaust steam passing through a portion of the flow path or the exhaust steam not passing through the flow path is discharged to the outside;
a first valve that adjusts opening of the first steam outlet port;
a second valve that adjusts opening of the second steam outlet port;
a first outlet line connecting the first steam outlet port and the first valve;
a second outlet line provided independently of the first outlet line and connecting the second steam outlet port and the second valve; and
a control unit that is electrically connected to the first valve and the second valve,
wherein an upstream side of the first valve is connected only to the first steam outlet port, and an upstream side of the second valve is connected only to the second steam outlet port,
wherein the second steam outlet port is arranged at a position that is closer to the second end of the outer casing main body in the direction along the axis than is a position where the steam inlet portion is arranged,
wherein the first steam outlet portion is arranged at a position that is closer to the first end of the outer casing main body in the direction along the axis than is the position where the steam inlet portion is arranged,
wherein the control unit is configured to adjust opening of the first and second valves such that an amount of exhaust steam larger than a half of the exhaust steam present in the outer casing is discharged through the first steam outlet port at a rated operation state, and
wherein an amount of exhaust steam larger than a half of the exhaust steam is discharged through the second steam outlet port in at least one of a period at which transition from the rated operation state to an operation stoppage state is performed and a period at which a transition from the operation stoppage state to the rated operation state is reached.

2. The steam turbine according to claim 1,
wherein the first valve and the second valve are on-off valves, and
wherein the control unit performs control such that the first valve is opened and the second valve is closed at the rated operation state, and performs control such that the first valve is closed and the second valve is opened in at least one of the period at which the transition from the rated operation state to the operation stoppage state is performed and the period at which the transition from the operation stoppage state to the rated operation state is reached.

3. The steam turbine according to claim 1,
wherein the first valve and the second valve are flow rate adjustment valves.

4. The steam turbine according to claim 1,
wherein the outer casing main body is provided with a steam inlet port through which the steam is introduced into the steam inlet portion,
wherein the steam turbine further comprises
a temperature measuring unit that measures at least one of a temperature of the steam inlet port, a temperature of the first steam outlet port, a temperature of the second steam outlet port, a temperature of the inner casing main body, a temperature of the exhaust steam inside the outer casing main body, and a temperature of the outer casing main body, and wherein the control unit controls opening and closing of the first and second valves when a slope of a curve of the temperature measured by the temperature measuring unit is greater than a predetermined slope at a predetermined time.

5. The steam turbine according to claim 1, further comprising:

a clearance measuring unit that measures a value of at least one of a first clearance formed between tip ends of a plurality of rotor blades and the inner casing main body and a second clearance formed between tip ends of a plurality of stator vanes and the outer casing main body, wherein the control unit adjusts the opening of the first and second valves based on a measured value of the at least one of the first and second clearances.

6. The steam turbine according to claim 1, wherein the inner casing main body is provided with a first casing main body portion, into which first steam having a first pressure is introduced and from which the first steam is discharged as first exhaust steam through one end thereof, and a second casing main body portion, into which second steam having a second pressure higher than the first pressure is supplied and from which the second steam is discharged as second exhaust steam through one end thereof, wherein the steam inlet portion is provided with a first steam inlet portion through which the first steam is introduced into the first casing main body portion and a second steam inlet portion through which the second steam is introduced into the second casing main body portion, wherein the outer casing main body is provided with a third steam outlet port through which the second exhaust steam is discharged to the outside of the outer casing, wherein the flow path through which the first exhaust steam flows is defined between an outer circumferential surface of the first casing main body portion and an inner circumferential surface of the outer casing main body, wherein, through the first steam outlet port, the first exhaust steam flowing through the entire length of the flow path in the direction along the axis is discharged to the outside of the outer casing, and wherein, through the second steam outlet port, the first exhaust steam passing through a portion of the flow path or the first exhaust steam not passing through the flow path is discharged to the outside of the outer casing.

7. The steam turbine according to claim 6, wherein the first valve and the second valve are on-off valves, and wherein the control unit performs control such that the first valve is opened and the second valve is closed at the rated operation state and performs control such that the first valve is closed and the second valve is opened in at least one of the period at which the transition from the rated operation state to the operation stoppage state is performed and the period at which the transition from the operation stoppage state to the rated operation state is reached.

8. The steam turbine according to claim 6, wherein the first valve and the second valve are flow rate adjustment valves, and wherein the control unit adjusts the opening of the first and second valves such that an amount of exhaust steam larger than a half of the exhaust steam present in the outer casing is discharged through the first steam outlet port at the rated operation state and an amount of exhaust steam larger than a half of the exhaust steam is discharged through the second steam outlet port in at least one of the period at which the transition from the rated operation state to the operation stoppage state is performed and the period at which the transition from the operation stoppage state to the rated operation state is reached.

9. The steam turbine according to claim 1, wherein the first end of the outer casing main body faces a second end of the inner casing main body and the second end of the outer casing main body faces the first end of the inner casing main body.

10. The steam turbine according to claim 1, wherein a flow path entrance adjustment member that narrows an entrance of the flow path is provided between the outer circumferential surface of the inner casing main body and an inner circumferential surface of the outer casing main body, and is positioned at the first end of the inner casing main body.

11. The steam turbine according to claim 1, wherein the outer casing main body is divided into an upper portion and a lower portion in a vertical direction, wherein the second steam outlet port is disposed in the upper portion or the lower portion and is positioned closer to the first end of the inner casing main body than an opposite second end of the inner casing main body, wherein a flow path blocking member is disposed between the inner casing main body and one of the upper portion and the lower portion of the outer casing main body that is not provided with the second steam outlet port such that the flow path blocking member blocks a half side of the flow path on which the second steam outlet port is not provided, and wherein the first steam outlet port is disposed in a portion of the outer casing main body that is positioned between the flow path blocking member and the second end of the inner casing main body.

12. The steam turbine according to claim 1, wherein the outer casing main body is divided into an upper portion and a lower portion in a vertical direction, wherein the outer casing is provided with a first flange portion provided outside the upper portion of the outer casing main body and a second flange portion provided outside the lower portion of the outer casing main body, wherein the outer casing is supported by a frame connected to the first flange portion, and wherein a flow rate control member that decreases a flow rate of exhaust steam flowing through a lower portion of the flow path is provided between a second end of a lower portion of the inner casing main body and the lower portion of the outer casing main body.

13. The steam turbine according to claim 1, wherein the outer casing main body is divided into an upper portion and a lower portion in a vertical direction, wherein the outer casing is provided with a first flange portion provided outside the upper portion of the outer casing main body and a second flange portion provided outside the lower portion of the outer casing main body, wherein the outer casing is supported by a frame connected to the second flange portion, and wherein a flow rate control member that decreases a flow rate of exhaust steam flowing through an upper portion of the flow path is provided between a second end of an upper portion of the inner casing main body and the upper portion of the outer casing main body.

* * * * *